US011168548B2

(12) United States Patent
Elmer

(10) Patent No.: US 11,168,548 B2
(45) **Date of Patent: *Nov. 9, 2021**

(54) COMPRESSOR FOR GAS LIFT OPERATIONS, AND METHOD FOR INJECTING A COMPRESSIBLE GAS MIXTURE

(71) Applicant: Encline Artificial Lift Technologies LLC, Houston, TX (US)

(72) Inventor: William G. Elmer, Tyler, TX (US)

(73) Assignee: Encline Artificial Lift Technologies LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/840,350

(22) Filed: Apr. 4, 2020

(65) Prior Publication Data

US 2020/0232307 A1 Jul. 23, 2020

Related U.S. Application Data

(60) Division of application No. 15/678,066, filed on Aug. 15, 2017, now Pat. No. 10,619,462, which is a (Continued)

(51) Int. Cl.
*E21B 43/12* (2006.01)
*F04D 29/58* (2006.01)
(Continued)

(52) U.S. Cl.
CPC ..... *E21B 43/122* (2013.01); *E21B 43/38* (2013.01); *F04D 27/004* (2013.01);
(Continued)

(58) Field of Classification Search
CPC ..... E21B 43/122; F04D 17/12; F04D 25/16; F04D 13/062; F04D 19/02; F04D 27/002; F04D 27/004; F04D 27/006; F04D 27/0246; F04D 29/5826; F04D 29/5833; F28D 1/0472; F28D 1/024; H02K 5/132; H02K 2205/09
See application file for complete search history.

(56) References Cited

U.S. PATENT DOCUMENTS 2,001,704 A * 5/1935 Bulkeley ..... F24F 11/30 165/229
4,052,885 A * 10/1977 Shuck ..... E21B 49/008 73/38

(Continued)

*Primary Examiner* — Jennifer H Gay
(74) *Attorney, Agent, or Firm* — Peter L. Brewer; Thrive IP

(57) ABSTRACT

A gas compressor system is provided to operate at a well site and to inject a compressible fluid into a wellbore in support of a gas-lift operation. Methods and systems are provided that allow for the automated individual control of discharge temperatures from coolers for gas injection, in real time, wherein the temperature control points of the first and/or second stage cooler discharges are automatically controlled by a process controller in order to push heat produced by adiabatic compression to a third or final compression stage. In this way, discharge temperatures at the final stage are elevated to maintain injection gaseous mixtures in vapor phase.

13 Claims, 10 Drawing Sheets

Related U.S. Application Data continuation-in-part of application No. 15/186,443, filed on Jun. 18, 2016, now Pat. No. 10,077,642.

(60) Provisional application No. 62/385,103, filed on Sep. 8, 2016, provisional application No. 62/207,038, filed on Aug. 19, 2015.

(51) Int. Cl.

| | |
|---|---|
| ***F04D 27/00*** | (2006.01) |
| ***E21B 43/38*** | (2006.01) |
| ***F28D 1/02*** | (2006.01) |
| ***F28D 1/047*** | (2006.01) |

(52) U.S. Cl.

CPC ..... *F04D 27/006* (2013.01); *F04D 29/5826* (2013.01); *F28D 1/024* (2013.01); *F28D 1/0472* (2013.01)

(56) References Cited

U.S. PATENT DOCUMENTS 4,150,721 A * 4/1979 Norwood ..... E21B 43/00 137/625.64
4,352,376 A * 10/1982 Norwood ..... E21B 34/16 137/552.7
4,362,462 A * 12/1982 Blotenberg ..... F04D 29/5833 415/1
4,703,664 A * 11/1987 Kirkpatrick ..... E21B 21/001 73/152.21
5,132,904 A * 7/1992 Lamp ..... E21B 34/16 166/53
RE34,111 E * 10/1992 Wynn ..... E21B 43/121 166/105
5,636,693 A * 6/1997 Elmer ..... E21B 43/121 166/370
5,711,157 A * 1/1998 Ohtani ..... F25B 9/10 62/467
5,735,346 A * 4/1998 Brewer ..... E21B 47/047 166/250.03
5,785,123 A * 7/1998 Lea, Jr. ..... E21B 43/121 137/624.15
5,819,848 A * 10/1998 Rasmuson ..... F04B 47/02 166/250.15
5,850,742 A * 12/1998 Bang ..... F24F 1/0011 62/89
5,878,817 A * 3/1999 Stastka ..... E21B 43/121 166/372
5,937,946 A * 8/1999 Streetman ..... E21B 43/34 166/267
5,941,305 A * 8/1999 Thrasher ..... E21B 47/008 166/53
5,957,200 A * 9/1999 Majek ..... E21B 34/16 166/250.15
5,983,164 A * 11/1999 Ocondi ..... E21B 47/00 702/12
6,041,609 A * 3/2000 Hornsleth ..... F04B 39/06 62/259.2
6,209,642 B1 * 4/2001 Streetman ..... E21B 34/16 166/267
6,241,014 B1 * 6/2001 Majek ..... E21B 43/121 166/372
6,293,341 B1 * 9/2001 Lemetayer ..... E21B 43/122 166/250.15
6,536,522 B2 * 3/2003 Birckhead ..... E21B 43/121 166/250.15
6,595,287 B2 * 7/2003 Fisher ..... E21B 43/12 166/250.15
6,595,294 B1 * 7/2003 Dalsmo ..... E21B 43/122 166/250.01
6,632,136 B2 * 10/2003 Anderson ..... A01F 12/448 460/101
6,672,392 B2 * 1/2004 Reitz ..... E21B 43/121 166/372
6,705,074 B2 * 3/2004 Horii ..... F02C 7/1435 60/39.53
6,883,606 B2 * 4/2005 Evans ..... E21B 47/008 166/250.15
7,000,411 B2 * 2/2006 Kim ..... F24F 1/06 62/183
7,114,557 B2 * 10/2006 Cudmore ..... E21B 43/128 166/52
7,389,684 B2 * 6/2008 Roy ..... E21B 43/122 73/152.29
7,490,675 B2 * 2/2009 Hearn ..... E21B 47/06 166/372
7,784,548 B2 * 8/2010 Wilson ..... E21B 43/122 166/370
7,909,585 B2 * 3/2011 Clancy ..... F04B 39/123 417/313
8,113,288 B2 * 2/2012 Bachtell ..... E21B 43/122 166/372
8,281,853 B1 * 10/2012 Hill ..... E21B 43/121 166/90.1
8,920,538 B2 * 12/2014 Adler ..... C10L 3/106 95/39
9,175,687 B2 * 11/2015 Hirata ..... F04D 15/0263
9,291,409 B1 * 3/2016 Heath ..... B01F 3/04021
9,377,164 B2 * 6/2016 Utal ..... F17C 13/123
9,391,409 B2 * 7/2016 Abe ..... H01R 24/38
9,764,255 B1 * 9/2017 Mueller ..... B01D 53/1406
9,784,076 B2 * 10/2017 Bjorge ..... E21B 43/01
9,932,989 B1 * 4/2018 Heath ..... B01D 53/265
9,951,601 B2 * 4/2018 Rashid ..... E21B 47/008
9,951,763 B2 * 4/2018 Hritz ..... F04B 25/005
10,077,642 B2 * 9/2018 Elmer ..... E21B 43/122
10,619,462 B2 * 4/2020 Elmer ..... F28D 1/0472
2002/0074118 A1 * 6/2002 Fisher ..... E21B 43/12 166/250.15
2003/0145986 A1 * 8/2003 Evans ..... E21B 47/008 166/250.15
2004/0123987 A1 * 7/2004 Reitz ..... E21B 43/121 166/370
2004/0231347 A1 * 11/2004 Kim ..... F24F 1/06 62/183
2007/0012442 A1 * 1/2007 Hearn ..... E21B 43/121 166/250.15
2007/0275471 A1 * 11/2007 Coward ..... E21B 43/122 436/55
2007/0276542 A1 * 11/2007 Coward ..... E21B 43/00 700/273
2008/0008602 A1 * 1/2008 Pozivil ..... F17C 9/00 417/243
2009/0266554 A1 * 10/2009 Wilson ..... E21B 43/38 166/372
2010/0276160 A1 * 11/2010 Tolman ..... E21B 43/14 166/386
2011/0168413 A1 * 7/2011 Bachtell ..... E21B 43/122 166/401
2013/0233388 A1 * 9/2013 Utal ..... F17C 13/083 137/1
2014/0151015 A1 * 6/2014 Sun ..... F25B 49/02 165/253
2015/0027693 A1 * 1/2015 Edwards ..... E21B 43/121 166/250.03
2015/0322934 A1 * 11/2015 Hritz ..... F04B 39/06 417/53
2016/0053753 A1 * 2/2016 Rashid ..... E21B 43/122 700/282
2016/0123351 A1 * 5/2016 Nagao ..... F04D 15/0005 415/1
2017/0051588 A1 * 2/2017 Elmer ..... E21B 43/122
2017/0174049 A1 * 6/2017 He ..... F04D 27/002
2017/0356278 A1 * 12/2017 Nandola ..... E21B 47/06
2018/0016880 A1 * 1/2018 Elmer ..... F04D 27/006
2020/0232307 A1 * 7/2020 Elmer ..... F04D 27/004
2021/0025324 A1 * 1/2021 Morris ..... H02K 7/1823

* cited by examiner

COMPRESSOR FOR GAS LIFT OPERATIONS, AND METHOD FOR INJECTING A COMPRESSIBLE GAS MIXTURE

CROSS REFERENCE TO RELATED APPLICATIONS

This application is a Continuation-In-Part of U.S. Ser. No. 15/186,443 filed Jun. 18, 2016. That application is entitled "Gas Compression System for Wellbore Injection, and Method for Optimizing Gas Injection," and is incorporated herein in its entirety by reference.

This application also claims the benefit of U.S. Ser. No. 62/385,103 filed Sep. 8, 2016. That application is entitled "Improved Compressor For Gas Lift Operations, and Method For Injecting A Compressible Gas Mixture," and is incorporated herein in its entirety by reference as well.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to an improved gas compressor used for gas lift operations, and methods for optimizing the injection of compressible fluids into a well to assist in the lift of production fluids to the surface. The invention also relates to real time temperature control for a gas compressor system at a wellbore.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

In completing a wellbore, it is common for the drilling company to place a series of casing strings having progressively smaller outer diameters into the wellbore. These include a string of surface casing, at least one intermediate string of casing, and a production casing. The process of drilling and then cementing progressively smaller strings of casing is repeated until the well has reached total depth. In some instances, the final string of casing is a liner, that is, a string of casing that is not tied back to the surface. The final string of casing, referred to as a production casing, is also typically cemented into place.

To prepare the wellbore for the production of hydrocarbon fluids, a string of tubing is run into the casing. The tubing becomes a string of production pipe through which hydrocarbon fluids may be lifted. Of interest herein, an annular region is formed between the production tubing and the surrounding casing string.

Some wellbores are completed primarily for the production of gas (or compressible hydrocarbon fluids), as opposed to oil. Other wellbores initially produce hydrocarbon liquids, but over time transition to the production of gases. In either of such wellbores, the formation will frequently produce fluids in both gas and liquid phases. Liquids may include water, oil and condensate.

At the beginning of production, the formation pressure is typically capable of driving the liquids with the gas up the wellbore and to the surface. Liquid fluids will travel up to the surface with the gas primarily in the form of entrained droplets. However, during the life of the well, the natural reservoir pressure will decrease as gases and liquids are removed from the formation.

As the natural downhole pressure of the well decreases, the gas velocity moving up the well drops below a so-called critical flow velocity. See G. Luan and S. He, *A New Model for the Accurate Prediction of Liquid Loading in Low-Pressure Gas Wells*, Journal of Canadian Petroleum Technology, p. 493 (November 2012) for a recent discussion of mathematical models used for determining a critical gas velocity in a wellbore. In addition, the hydrostatic head of fluids in the wellbore will work against the formation pressure and block the flow of in situ gas into the wellbore. The result is that formation pressure is no longer able, on its own, to produce fluids from the well in commercially viable quantities.

In response, various remedial measures have been taken by operators. For example, operators have sometimes sought to enhance the production of gas by replacing the original production tubing with a smaller-diameter string. A packer may be placed at a lower end of the new production sting to seal the annular area formed between the tubing and the surrounding strings of casing and to force the movement of gas to the surface through the smaller orifice. The smaller-diameter string creates a restricted flow path at the bottom of the wellbore, increasing pressure and aiding the flow of hydrocarbons to the surface.

A common technique for artificial lift in both oil and gas wells is the gas lift system. Gas lift refers to a process wherein a gas (typically methane, ethane, propane, nitrogen and related produced gas combinations) is injected into the wellbore downhole to reduce the density of the fluid column. Injection is done through so-called gas lift valves stacked vertically along the outside diameter of the production tubing. The injection of gas through the valves and into the production tubing decreases the backpressure against the formation. In some cases, a small dedicated tubing line is run down the annular region, clamped to the outer diameter of the production string.

In either instance, gas-lift systems have particular benefit for wells that have insufficient bottom hole pressure to support other forms of lift. Gas-lift wells are also used for producing deeper wells that have difficulty producing against a tall hydrostatic head. Still further, gas-lift systems do not suffer from gas interference problems caused by lighter hydrocarbons coming out of solution, as experienced with other forms of lift.

With the advent of the horizontal oil shale boom, gas lift systems have become increasingly useful as an artificial lift technique. This is primarily because of the ability of gas lift systems to manage entrained solids such as frac sand and scale. This is also because gas-lift wells do not experience the mechanical limitations that beam lift and electric submersible lift wells experience with non-vertical wells. Incidentally, gas lift is also popular for lifting oil wells in large fields or offshore facilities, as the power station may be remotely located from the wells.

In any instance, gas-lift systems rely upon compressors located at the surface that inject gas down the well annulus. When gas-lift systems became popular in the first half of the 20th century, injection (or reinjection) was provided from large central compressor stations having multiple banks, or stages, of compressors. Individual compressors were typically only designed to perform one stage of compression, meaning a series of compressors (or banks of compressors) were used to perform sequential stages of compression until the desired injection pressure was reached. Often, lean-oil "gas plants" were associated with these compressor stations, which would strip the propane, butane, hexane, and other components knows as natural gas liquids (or "NGL's") from the gas prior to reinjection.

Compressor technology has improved in the last 60 years, with the advent of higher horsepower engines and compressor frames having smaller footprints. The large central compressor facilities have been replaced by smaller distributed compressor stations, with individual compressors capable of performing all stages of compression (usually three stages). However, the gas plant technology has not migrated to the field level due to economies of scale and the significant investment required. Stated another way, local compressors do not have an associated separator for stripping out NGL's.

It is observed that operators will install and use the same compressor for both their well-site injection as used for post-production gas sales. Beneficially, gas-lift compression and gas sale compression normally have the same discharge pressure requirements, that is, (1,000 to 1,200 psig). Thus, the well site compressor is physically capable of performing either task. However, design components favorable to "gas sales" work against the successful operation of a "gas-lift" compressor, primarily due to the NGL components that have not been removed due to the lack of an on-site gas plant. When NGL components go through the compression cycle, they often condense in the gas coolers. This causes multiple operating problems for the compression process, and results in additional expense, additional downtime, and sometimes environmentally un-friendly practices.

FIG. 1 presents a phase diagram 100 showing pressure (in PSIA) of natural gas as a function of temperature (in ° F.). Specifically, the natural gas is predominantly methane, with diminishing concentrations of ethane, propane and hexane. Trace amounts of carbon dioxide, nitrogen and sulfuric components may also be present.

As can be seen, at the lowest temperatures the natural gas mixture will reside in a fully liquid phase 110. Note that these are low, sub-zero temperatures. As temperature increases, the mixture will enter a two-phase condition 120 comprised of liquids and gases. The higher the pressure, the more liquids will be present. Finally, as the temperature increases, the mixture will enter a fully vapor phase 130.

For gas compressors, proper control of gas temperatures at elevated levels means keeping pressures and temperatures in the vapor phase 130. This will prevent condensation of any hydrocarbons and the attendant operational problems.

Accordingly, a compression system and method are needed that allow for the real-time control of discharge temperatures from compressors using on-site heat exchangers. A need further exists for a multi-stage compressor system for wellbore gas injection wherein the temperature control points of first and/or second stage cooler discharges are automatically controlled in order to push heat produced by adiabatic compression to the third (or a final) stage. Preferably, discharge temperatures throughout the compression process are elevated to maintain gas in the vapor phase.

BRIEF SUMMARY OF THE INVENTION

A gas compressor system is first provided herein. The gas compressor system is designed to operate at a well site and to inject a compressible fluid into the wellbore in support of a gas-lift operation.

The gas compressor system utilizes a multi-stage compressor at the well. The gas compressor system first includes an inlet line. The inlet line is configured to receive a working fluid comprising a natural gas mixture, and to introduce the working fluid into the multi-stage compressor. Preferably, the natural gas mixture represents a portion of hydrocarbon fluids produced at the well and separated out through initial fluid separation. The natural gas mixture may comprise methane and any of (i) ethane, (ii) propane, (iii) butane, (iv) pentane, (v) hexanes and higher carbon compounds, (vi) carbon dioxide, (vii) nitrogen, (viii) hydrogen sulfide, or (ix) combinations thereof.

The gas compressor system also includes a fluid separator. The fluid separator is configured to remove any liquids from the natural gas mixture at a first pressure. In one aspect, the liquids dropped out of the first separator are routed back to a production separator at or near the well. Such liquids may include water and NGL's.

The gas compressor system further comprises a first compressor unit. The first compressor unit is configured to receive a gaseous mixture from the fluid separator, and discharge the gaseous mixture at a second pressure that is higher than the first pressure. It is understood here that the gaseous mixture represents the portion of the working fluid remaining after liquids have been dropped out of the first separator.

The gas compressor system will also include a first cooler. The first cooler is a heat exchanger configured to receive the gaseous mixture from the first compressor unit, and then cool the gaseous mixture to a first cooled temperature. From there, the cooled gaseous mixture is discharged. This represents a first stage of compression.

The gas compressor system will additionally include a second compressor unit. The second compressor unit is configured to receive the cooled gaseous mixture from the first stage, and discharge the cooled gaseous mixture at a third pressure that is higher than the second pressure.

The system will also comprise a second cooler. The second cooler is configured to receive the gaseous mixture from the second compressor unit, and then further cool the gaseous mixture to a second cooled temperature. The cooled gaseous mixture is then discharged as a second stage.

The gas compressor system will also include a third compressor unit. The third compressor unit is configured to receive the cooled gaseous mixture from the second stage, and discharge the cooled gaseous mixture as a third stage.

Optionally, though not preferably, the gas compressor system will include a third cooler. The third cooler is configured to receive the compressed gaseous mixture from the third compressor unit, and cool the gaseous mixture to a third cooled temperature. The cooled gas is then discharged as a third stage. Preferably, this third stage is the final stage, and the cooled and compressed gaseous mixture leaving the third stage is directed to the wellbore for the gas-lift operation. However, it is understood that a fourth compression stage may be optionally employed.

The gas compressor system will also have a process controller. The controller is configured to send signals to the first cooler, the second cooler, and the optional third cooler to maintain the gaseous mixture at each of the first, second and third respective stages at a temperature wherein the gaseous mixture is maintained substantially in a vapor phase at each stage.

In one embodiment, the compressor system will further comprise:

- a tubing string placed in the wellbore, wherein the tubing string extends from a surface down to a selected subsurface formation;
- an annular region residing around the tubing string, the annular region also extending down into the wellbore and to the subsurface formation;
- a production line at the surface and in fluid communication with the tubing string; and
- a gas injection line at the surface configured to inject the gaseous mixture from a third stage gas outlet line as a compressible fluid into the annular region.

It is preferred that adjusting temperatures of the gaseous mixture at the first, second and third stages is done at the first and second coolers. To accomplish this, the gas compressor system will further comprise:

- a fan to provide air flow across cooling tubes in each of the coolers;
- a first louver placed along an inlet or an outlet of the first cooler;
- a first air motor (or other position actuator) mounted to the first louver and configured to adjust a position of the first louver and, thereby, adjust air flow across the cooling tubes within the first cooler;
- a first transducer configured to receive voltage (or other electrical) signals from the process controller, and convert the electrical signals from the first process controller into air pressure signals for the first air motor to adjust the position of the first louver;
- a second louver placed along an inlet or an outlet of the second cooler;
- a second air motor (or other position actuator) mounted to the second louver and configured to adjust a position of the second louver and, thereby, adjust air flow across the cooling tubes within the second cooler; and
- a second transducer configured to receive voltage (or other electrical) signals from the process controller, and convert the electrical signals from the second process controller into air pressure signals for the second air motor to adjust the position of the second louver.

Optionally, a third louver is placed along an inlet or an outlet of a third cooler along with, optionally, a third air motor configured to adjust a position of the third louver and, thereby, adjust air flow across cooling tubes within the third cooler. Optionally, a third transducer configured to receive voltage (or other electrical) signals from the process controller, and convert the electrical signals from the process controller into air pressure signals for the third air motor to adjust the position of the third louver.

In this embodiment, the electrical signals from the process controller comprise temperature control variables or output control points for the respective coolers. The set point for each stage of temperature control is calculated in the process controller and through a proportional-integral-derivative ("PID") loop or subset such as PI algorithm comparing the temperature process variable with the set point resulting in a real time adjustment of the control variable for each cooler's temperature control PID loop.

To further accomplish the adjustment of temperatures at the first, second and (optional) third coolers, the gas compressor system may further comprise:

- a first thermocouple placed along a gas outlet line from the first cooler configured to measure a gas outlet temperature at the first stage as real time temperature readings;
- a first signal conditioner configured to convert the real time temperature readings from the first stage into analog input signals, and transmit the first stage analog input signals to the process controller;
- a second thermocouple placed along a gas outlet line from the second cooler configured to measure a gas outlet temperature at the second stage as real time temperature readings;
- a second signal conditioner configured to convert the real time temperature readings from the second stage into analog input signals, and transmit the second stage analog input signals to the process controller;
- a third thermocouple placed along the gas outlet line configured to measure a gas outlet temperature at the final stage as real time temperature readings; and
- a third signal conditioner configured to convert the real time temperature readings from the third stage into analog input signals, and transmit the final stage analog input signals to the process controller.

A method of compressing a gas for injection into a wellbore in support of a gas-lift operation is also provided herein. The method employs the gas compressor system as described above, in its various embodiments. Preferably, the gas compressor system is associated with a wellbore that is horizontally completed, but this is certainly not required.

The method first includes providing a wellbore. The wellbore has been formed for the purpose of producing hydrocarbon fluids from a well to the surface in commercially viable quantities. Preferably, the well primarily produces hydrocarbon fluids that are compressible at surface conditions, e.g., methane, ethane, propane, butane, pentane and hexanes plus.

The method next includes associating a multi-stage gas compressor with the wellbore. The multi-stage gas compressor comprises a first stage cooler, a second stage cooler and, optionally, a final stage cooler. The method also includes producing hydrocarbon fluids through a production tubing in the wellbore, up to the surface. An annular region is formed between the production tubing and a surrounding casing string.

In the method, discharge temperatures from each of the coolers are controlled in real time. In one aspect, the multi-stage compressor system comprises three stages, meaning that the final stage cooler is a third stage cooler. Temperature set-points of the first and/or second stage cooler discharges are automatically controlled by a process controller in order to push heat produced by adiabatic compression to a third (or final) stage, so that discharge temperatures at the third (or final) stage are elevated to maintain injection gas in vapor phase, and thereby prevent problems such as line freeze caused by hydrate formation, as well as preventing paraffin formation inside the production tubing.

The method also includes injecting gas into the annular region while producing hydrocarbon fluids through the production tubing in the wellbore. Hydrocarbon fluids are produced up to the surface and into a production line.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
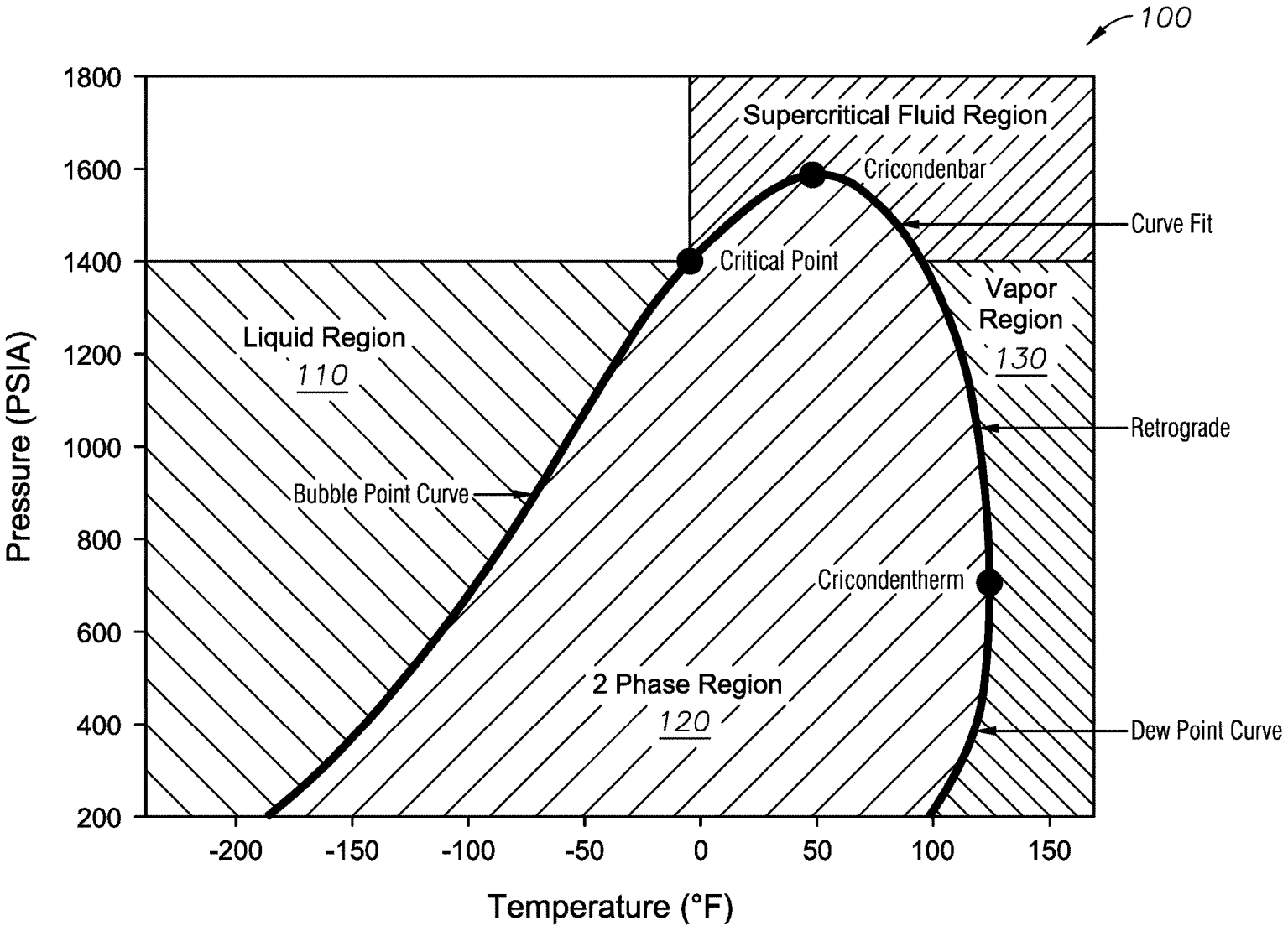
FIG. 1 is a fluid phase chart for a natural gas mixture. The chart shows fluid phase as a function of pressure and temperature. A cricondenbar and a cricondentherm are illustrated.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "gas" refers to a fluid that is in its vapor phase.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Description of Selected Specific Embodiments

Figure 2:
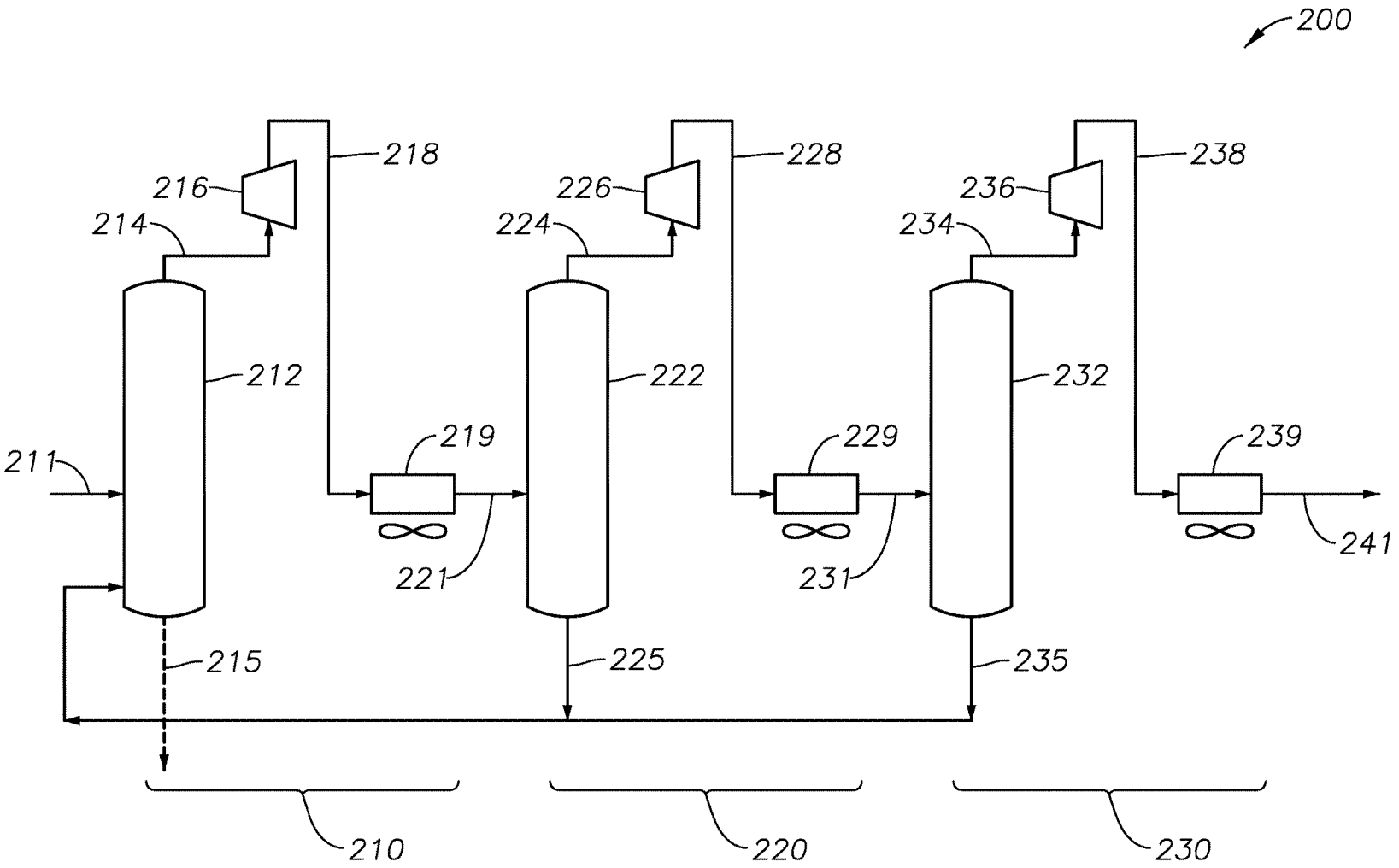
FIG. 2 (Prior Art)
FIG. 2 is a schematic illustration of a gas compressor system for a wellbore, as is known in the art. The illustrative gas compressor system is a three-stage system.

FIG. 2 is a schematic diagram of a well site gas compressor system 200. The compressor system 200 presents an illustrative three-stage gas compressor as is sometimes used in oilfield operations, particularly at a well site or at small field facility. First 210, second 220 and third 230 compression stages are shown. These stages are indicated by separate brackets.

In FIG. 2, the compressor system 200 receives a working fluid through an inlet line 211. The working fluid will be a natural gas mixture, such as the mixture described above. In one aspect, the natural gas mixture is obtained from a separator existing at the well site, such as a so-called heater treater, a gravitational separator or other device.

The natural gas mixture flows through inlet line 211 and enters a first scrubber 212. The first scrubber 212 is preferably a vertical vessel designed to remove liquid droplets from the mixture in inlet line 211. In operation, the mixture of line 211 will enter through a diverter, whereupon the heavy liquid particles will fall to the bottom of the vessel 212, while lighter gas phase components will rise in the vessel 212. A mist extractor (not shown) may be provided that captures smaller liquid particles entrained in the gas phase, causing them to also fall to the bottom of the vessel 212.

Water and other liquid components will gravitationally fall from the first scrubber 212 through line 215. The liquid of line 215 will be sent downstream for further processing. At the same time, the lighter gas components will exit at the top of the scrubber 212 through line 214.

The gaseous mixture of line 214 will enter a first compressor 216. The first compressor 216 will pressurize the gaseous components of line 214, such as up to 500 psig. The pressurized gaseous components then exit the first compressor 216 through exit line 218.

The pressurized gaseous components of line 218 are directed to a first cooler 219. The first cooler brings the temperature of the gaseous components of line 218 down to a lower temperature, such as 100° F. This causes a portion of the gaseous mixture to enter the liquid phase. The cooled mixture then exits the first cooler 219 through line 221. This completes the first stage 210.

The cooled mixture of line 221 next enters a second scrubber 222. The second scrubber 222 may be designed in accordance with the first scrubber 212. However, the second scrubber 222 will necessarily operate at a higher pressure due to the pressurization from the first compressor 216, such as up to 500 psig.

The mixture of line 221 will enter through a diverter, whereupon any heavy liquid particles will fall to the bottom of the vessel 222, while lighter gas phase components will rise in the vessel 222. A mist extractor (not shown) may optionally be provided that captures smaller liquid particles entrained in the gas phase, causing them to also fall to the bottom of the vessel 222. Gaseous fluids will exit at the top through line 224.

Water and other liquid components will gravitationally fall from the second scrubber 222 through line 225. The liquid of line 225 will be recycled back into the first scrubber 212 for re-capture. Ideally, only a small portion of liquid particles exist in line 225. Optionally, the liquid of line 225 will tee into line 215 for further processing and sale.

The gaseous mixture of line 224 will enter a second compressor 226. The second compressor 226 will further pressurize the gaseous components of line 224, such as up to 750 psig. The further pressurized gaseous components then exit the second compressor 226 through exit line 228.

The pressurized gaseous components of line 228 are directed to a second cooler 229. The second cooler 229 brings the temperature of the gaseous components of line 228 down to a lower temperature, such as 100° F. This causes a portion of the gaseous mixture to again enter the liquid phase. The cooled mixture then exits the second cooler 229 through line 231. This completes the second stage 220.

The further cooled mixture of line 231 next enters a third scrubber 232. The third scrubber 232 may be designed in accordance with the first scrubber 212. However, the third scrubber 232 will necessarily operate at a higher pressure due to the combined pressurization from the first 216 and second 226 compressors, that is, up to 1,500 psig.

The gaseous mixture of line 231 will enter through a diverter, whereupon any heavy liquid particles will fall to the bottom of the vessel 232, while lighter gas phase components will rise in the vessel 232. The gas phase fluids will travel through line 234 at the top of the vessel 232.

Water and other liquid components will gravitationally fall from the third scrubber 232 through line 235. The liquid components of line 235 will join the liquid components of line 225, and will be recycled back into the first scrubber 212 for re-capture. Optionally, the liquid components of line 235 and 225 will tee into line 215 for further processing. Ideally, only a very small portion of liquid particles exist in line 235.

The gaseous mixture of line 234 will enter a third and final compressor 236. The third compressor 236 will further pressurize the gaseous components of line 234, such as up to 4,000 psig. The further pressurized gaseous components then exit the third compressor 236 through exit line 238.

The pressurized gaseous components of line 238 may be directed to a third cooler 239. The third cooler 239 brings the temperature of the gaseous components of line 238 down to a lower temperature, such as 100° F. The cooled mixture then exits the third cooler 239 through line 241. This completes the third stage 230.

Line 241 represents gaseous components suitable for injection into a wellbore for gas-lift operations. The gaseous components may be at a pressure of between 400 and 4,000 psig. However, it is observed that a portion of the gaseous mixture in line 241 will likely be in the liquid phase.

As noted above, the compressor system 200 of FIG. 2 offers a three-stage compression system. The stages represent first stage 210, second stage 220 and third stage 230. The three stages 210, 220, 230 provide outlets in lines 221, 231 and 241, respectively. For wellsite and small facility compression, the operator ignores the outlet temperatures, which are in the two-phase region 120 of the phase diagram 100. This results in collecting fluid in the compressor separation vessels 222 and 232 downstream of the gas coolers 219, 229. It also again results in fluid being present in discharge line 241.

To keep the outlet lines 221, 231, 241 from freezing, standard procedure is to inject methanol into dump lines leading to atmospheric tanks which will freeze underground as components like propane change from a liquid to vapor. Those of ordinary skill in the art will understand that methanol pumps are present (though not shown in FIG. 2) in gas-lift compressor stations of the prior art. Methanol pumps are placed, for example, along lines 218, 228 and 238. Such methanol pumps are expensive and require constant maintenance.

It is proposed herein to provide temperature control in a multi-stage compressor system to maintain the working fluid in a vapor phase. More specifically, it is proposed herein to control the temperature of the gases exiting the first 219, second 229 and third 239 coolers. This causes the NGL's to remain in a vapor state, and to then be injected into the producing wellbore without need of methanol pumps. Stated another way, the multi-stage compressor prevents liquid formation by controlling the amount of gas cooling performed after each stage of compression. Such a system ideally avoids the need for the second 222 and third 232 stage scrubbers, or at a minimum allows for much-reduced scrubber sizes. Such a system also removes the need for the third stage cooler 239. Indeed, where the ambient temperature is low, the second cooler 229 can likely be shut off, or the louver moved to a closed position depending on arrangement.

The new multi-stage compressor system utilizes a process controller that controls temperature and that keeps the NGL's in vapor state. The process controller may be a programmable logic controller (PLC), an embedded controller, or any controller suitable for the oil well applications environments. In one aspect, the controller is capable of performing proportional-integral-derivative (PID) loop control or a subset such as PI loop controls. The following represents the basics of an algorithm implemented into the process controller, in one embodiment. If the process controller is a PLC, the programming language is typically ladder logic. In the case of an imbedded controls implementation, the programming software is typically some form of "c" such as c or c++, or perhaps in a version of Basic such as T Basic.

The process controller of the new multi-stage compressor system calculates temperature set points and sends control output signals from output points on the process controller at the exemplary three stages such that the gaseous mixture is maintained substantially in the vapor phase at each stage 210, 220, 230. The temperature set-points of the first 221 and/or second 231 stage cooler discharges are automatically controlled in order to push heat produced by adiabatic compression to the third (or final) stage 230. In this way, discharge temperatures at the final stage 230 are elevated to maintain injection gas in vapor phase, or perhaps even higher in order to improve the efficacy of corrosion inhibition chemicals being pumped downhole, or to keep the wellbore hot in order to prevent paraffin formation in the production tubing.

Figure 3:
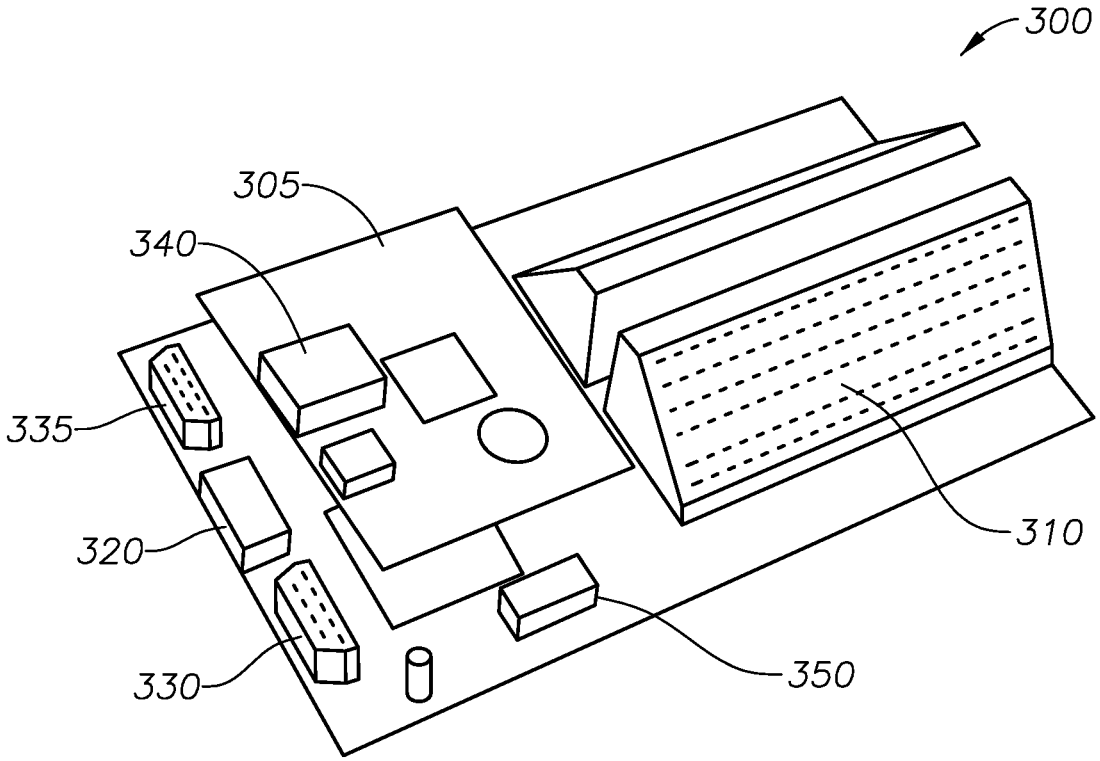
FIG. 3 is a photographic view of a process controller as may be used in the gas compressor system of the present invention, in one embodiment.

FIG. 3 is a photographic view of an illustrative PLC 300 as a suitable process controller. The illustrative controller 300 is a Triangle Research EZ Wire 1616 that provides integrated, field wiring ready I/O terminals, shown as Quick-Connect Terminals 310. Operations software is downloaded into the programmable logic controller 300. The Triangle Research EZ Wire 1616 controller is an embedded programmable logic controller (or "PLC"). This controller, is able to perform advanced floating point math, and has 16 digital inputs and 16 digital outputs.

The controller 300 provides digital and analog I/O points with its own power (+24V or +5V) and 0V on a 3-level screwless terminal. In one embodiment, the controller 300 has eight analog inputs and four analog outputs. Every sensor and actuator in a control system can be wired directly to the controller 300 without requiring additional screw terminal blocks and wire-harnesses. For example, the controller 300 includes an RS485 pinout cable connector 320.

The controller 300 has an RS232 male header 330. This serves as a data terminal equipment (DTE) connector. The DTE connector 330 converts user information into signals, or reconverts received serial signals. The controller 300 also has an RS232 female header 335. This serves as data circuit-terminating equipment DTE connector 335. The DTE device 330 may communicate with the DCE device 335.

The controller 300 further includes an Ethernet port 340. The Ethernet port may connect to other devices or web servers for control or data up/down loading. The controller 300 additionally includes a back-up battery, shown at 350. Suitable connections are provided on a printed circuit board 305.

In order to be successful in maintaining the gaseous mixtures in vapor phase using the new multi-stage compressor system, the compressor-cooling stages are controlled using the process controller 300 to control gas temperatures at elevated levels. In addition, the controller 300 keeps pressures and temperatures in the vapor phase so as to prevent condensation of any hydrocarbons.

In operation, the process controller 300 keeps the temperatures at inlets 221, 231 low enough to prevent or eliminate excessive temperature increases in the compressor cylinders. For example, instead of controlling the Stage Two cooler 229 outlet temperature at, for example, 130° F., the controller 300 might push heat to Stage Three 230 by setting the Stage Two cooler 229 outlet temperature to 200° F. This would be acceptable if the Stage Three discharge temperature stayed below 300° F., but not if the temperature were to reach, for example, 333° F. This is important since this is higher than the typical thermal shutdown threshold of 325° F.

Controlling the stage temperatures in such a way as to maintain temperatures and possibly pressures to prevent condensation of any hydrocarbons avoids the need for multiple scrubbers 222 and 232. Such further avoids line damage and loss of runtime due to freezing of system lines. That said, in case of process upsets, scrubbers provide a valuable insurance policy for protecting compressor components, so one option is to significantly downsize the scrubbers 222, 232 instead of eliminating them.

To better understand the new compressor system proposed herein, we must consider the idea of adiabatic compression. The term "adiabatic" generally refers to a process wherein no energy (or heat) is transferred to or from the gas during compression. In this situation, all supplied work is added to the internal energy of the gas, resulting in increases of temperature and pressure. Theoretical temperature rise is defined by:

$$T_2 = T_1\left(\frac{p2}{p1}\right)^{(k-1)/k}$$

where $T_2$=Post-compression temperature (in degrees Rankine or kelvins $T_1$=Pre-compression temperature p2=Post-compression pressure p1=Pre-compression pressure k=ratio of specific heats (approximately 1.4 for air)

It has been industry standard to design intercoolers for an approach to ambient temperature of 25 to 30° F., and aftercoolers with an approach temperature of 15 to 20° F. The latter requires typically double the heat exchanger area to accomplish this closer approach, due to diminishing returns of the additional tubes. While this is ideal for a "gas sales" compressor, where downstream gas quality treating equipment requires temperatures to be below 100° F. for proper operation, it is detrimental to "gas-lift" compressor operations due to the condensation of NGL's.

To show why, a comparison of two gas lift compression cases for the same well is presented. Case Two is one year after initial installation, and continuing for the remainder of the well's life. Pressures shown are absolute (PSIA) for simplicity:

TABLE 1

| Case | One (Compression Ratio) | Two (Compression Ratio) |
|---|---|---|
| Suction Pressure | 50 | 50 |
| Inter-stage 1 Pressure | 150 (3.00 Compression Ratio) | 140 (2.8 Compression Ratio) |
| Inter-stage 2 Pressure | 400 (2.67 Compression Ratio) | 370 (2.64 Compression Ratio) |
| Final Discharge Pressure | 1,000 (2.50 Compression Ratio) | 500 (1.35 Compression Ratio) |

The primary difference in these two cases is that the final discharge pressure has dropped in half, from 1,000 psia down to 500 psia. Note that the first two inter-stage pressures are minimally lower (relating to volumetric efficiency), and that the number of compression ratios performed in the final stage has dropped down from 2.5 to 1.35. Using the adiabatic temperature equation and an inlet temperature of 130° F., the final discharge temperature of Case One would be 249° F., while the final discharge temperature of Case Two would be only 166° F. This is undesirably cool.

Some industry coolers have manual louvers. This allows the degree of cooling within the heat exchangers to be adjusted. For example, it is possible to drop the cooler outlet temperatures to 50° F. when ambient temperatures fall to 30° F. In this case, the final discharge temperatures drop to 153° F. for Case One, and 82° F. for Case Two. These values are the temperatures before the gas enters the final discharge cooler (such as cooler 239 of FIG. 2). This is even more undesirably cool.

In oil and gas fields there are no trained personnel in proximity to adjust the louvers, and certainly there are no automated louver adjustments that would prevent such precipitous temperature drops. Without automated control of the quantity of air flow across the tube bundles, temperatures will easily fall below hydrocarbon dew points and into hydrate formation, particularly when ambient temperatures approach freezing.

It is observed that this issue may not be a problem in fields located in extremely warm climates, such as Saudi Arabia and other Middle East countries, or in Bakersfield, Calif. However, in locations where the ambient temperatures can drop to below freezing, uncontrolled operation of coolers can be detrimental to gas lift operations.

Some industry compressors have automated louvers, but utilize one pneumatic controller to measure the final stage discharge temperature. For example, some industry compressors will utilize a Kimray T-12 pneumatic temperature controller. The controller is designed to operate one air motor mounted to all three cooler section louvers. Given a situation like Case Two, where the first two louver sections need to be opened to disburse the heat load from performing multiple compression ratios, yet the third stage does not need to be opened, it is impossible for one temperature controller to operate correctly. The result will be that Stage 3 heat transfer will still be excessive, and temperatures varied greatly, causing the operator of the compressor to install a "Hot Gas Bypass" around the final discharge cooler. The mere presence of the hot gas bypass signifies that the single temperature controller actuating all louvers in unison is not successful.

Larger gas-lift compressors (typically 500+ HP) are often equipped with individual T-12 pneumatic controllers on each compression stage. However, the controllers operate independently of each other. For example, if the final compressor cylinder is receiving gas at a 130° F. inlet temperature, and discharging at 166° F. as in Case Two, it is impossible for the gas leaving the Stage 3 compressor 236 to reach a temperature above the incoming temperature of 166° F.

It is proposed herein to automatically elevate the set points of the first and/or second stage cooler 219, 229 discharge temperatures in order to push heat produced by adiabatic compression to the Stage 3 230 compression stage. This is done by installing a process controller 300 to view the process temperature variables, and make decisions on temperature set points minus process variable (temperatures). The process controller 300 communicates the resulting control outputs to position actuator devices that will adjust the existing louvers and optimize the degree of air being blown across the heat exchange tubes. These control devices may be, for example, I/P transducers or solenoids that operate air motors.

As an alternative to the use of air motors, electric linear actuators may be used. Linear actuators have small 12 to 24 DC motors in them, and a feedback resistor to allow detection of the actual position.

Returning to the above illustration, for the gas to exit the Stage 3 compressor 236 at a temperature higher than 166° F., such as 180° F., the set point control at the controller 300 could be set to about 160° F. This diminishes the heat transfer occurring in the Stage 2 cooler 229, and allows heat to continue into the Stage 3 compression.

Figure 4:
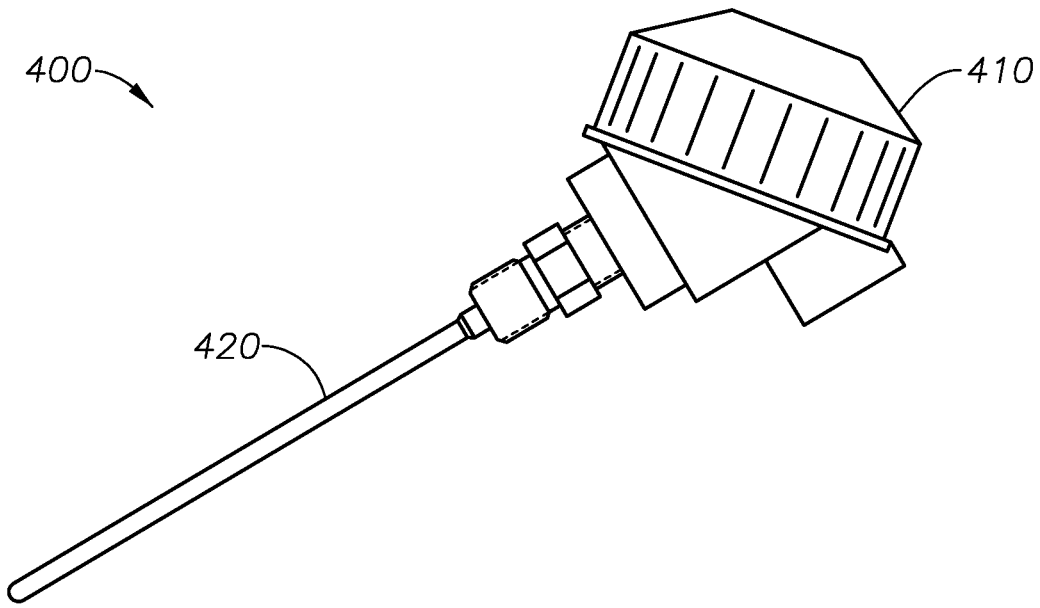
FIG. 4 is a photographic view of a thermocouple as may be used to monitor gas temperatures at the cooler discharge lines in the gas compressor system of the present invention, in one embodiment.

In order to implement the set point elevation process as calculated in the PLC 300, a plurality of temperature sensors are needed; otherwise, the Stage 1 219 and the Stage 2 229 compressors will not know the other compression process variables. FIG. 4 is a photographic view of an illustrative thermocouple 400 as may be used in the compressor system of the present invention. The illustrative thermocouple 400 is a ProSense Type J thermocouple in probe form. The thermocouple 400 is 4 inches in length, ¼" in diameter, and has a ½" NPT male connection head (not visible). The thermocouple 400 is spring-loaded and has an ungrounded junction.

The thermocouple 400 has a stainless steel sheath. It further has an IP66 rated aluminum screw cover connection head 410, and a ceramic terminal base with brass terminals and stainless steel screws. An elongated thermal probe is shown at 420. Of importance, the probe 420 is rated to sense temperatures in the range of 32° F. up to 1,330° F.

In the present system, each thermocouple 400 is configured to send signals indicative of the outlet line temperatures into analog inputs included in I/O terminals 310 into the PLC 300. Alternatively, the outlet line temperatures can be collected by other devices, such as the compressor control panel, and communicated to the PLC 300 through the RS485 Modbus port 320 or other ports.

Figure 5:
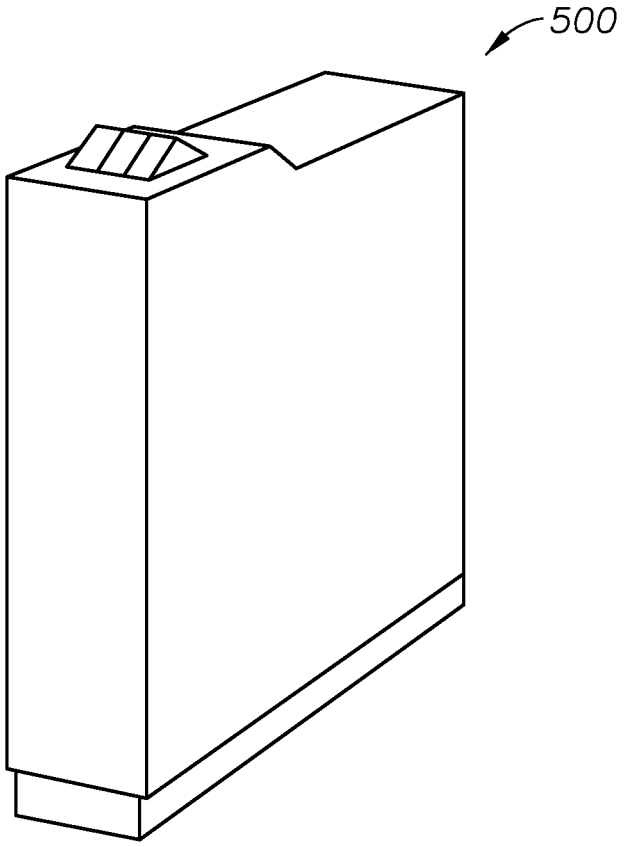
FIG. 5 is a photographic view of a signal conditioner as may be used to receive signals from the thermocouple of FIG. 4, and transmit them to the controller of FIG. 3, in one embodiment.

FIG. 5 is a photographic view of an illustrative temperature transmitter 500 as may be used in the compressor system of the present invention. The illustrative transmitter 500 is a ProSense, Type J transmitter having a thermocouple input that is compatible with the ProSense Type J thermocouple 400. The transmitter 500 includes an internal cold junction compensation, and a linear 2-wire 4-20 mA analog output.

The transmitter 500 has 2 kV isolation, is 12 to 35 VDC loop powered, and LED indication. The transmitter 500 also includes an integral 35 mm DIN rail mounting adapter with removable screw terminal plugs. Of importance, the transmitter 500 is has a pre-calibrated fixed temperature range of 0° F. to 500° F.

In response to temperature readings of the thermocouples 400 as sent by the transmitter 500, the process controller 300 keeps the inlet temperatures low enough to prevent excessive temperature increases in the compressor cylinders 216, 226. For example, for the final stage of compression in Case One, an inlet temperature of 200° F. (instead of 130° F.) could result in a final stage discharge temperature of 333° F., which is higher than the typical shutdown set point of 325° F. To prevent this from happening, the controller 300 may reduce the temperature from 200° F. to, perhaps, 170° F., realizing a final discharge temperature approximating 303° F. instead of 333° F.

Figure 8A:
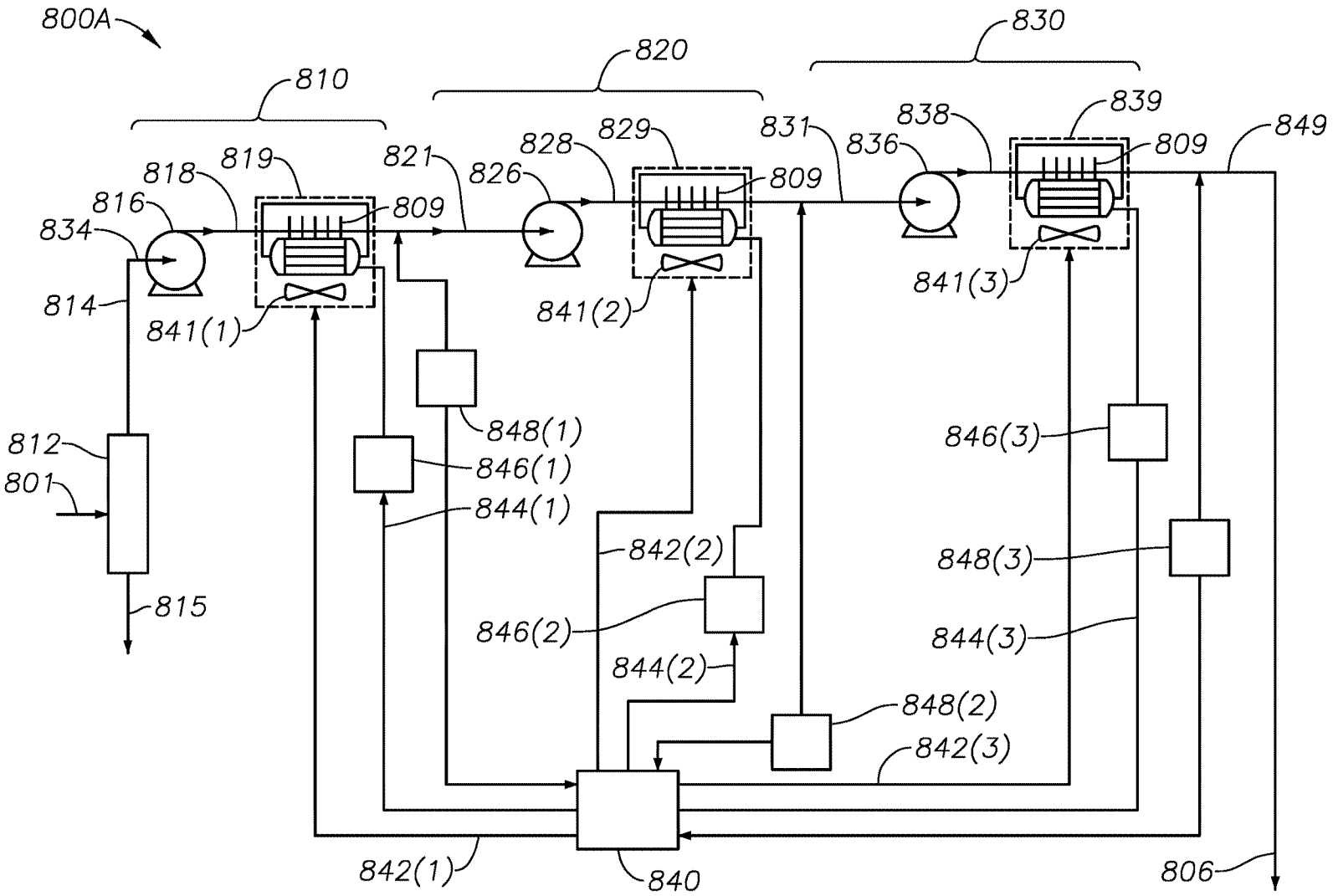
FIG. 8A is a first schematic illustration of an improved gas compressor system for a wellbore, based on advanced controls using a process controller. The illustrative gas compressor system is a three-stage system utilizing only one scrubber.
Figure 8B:
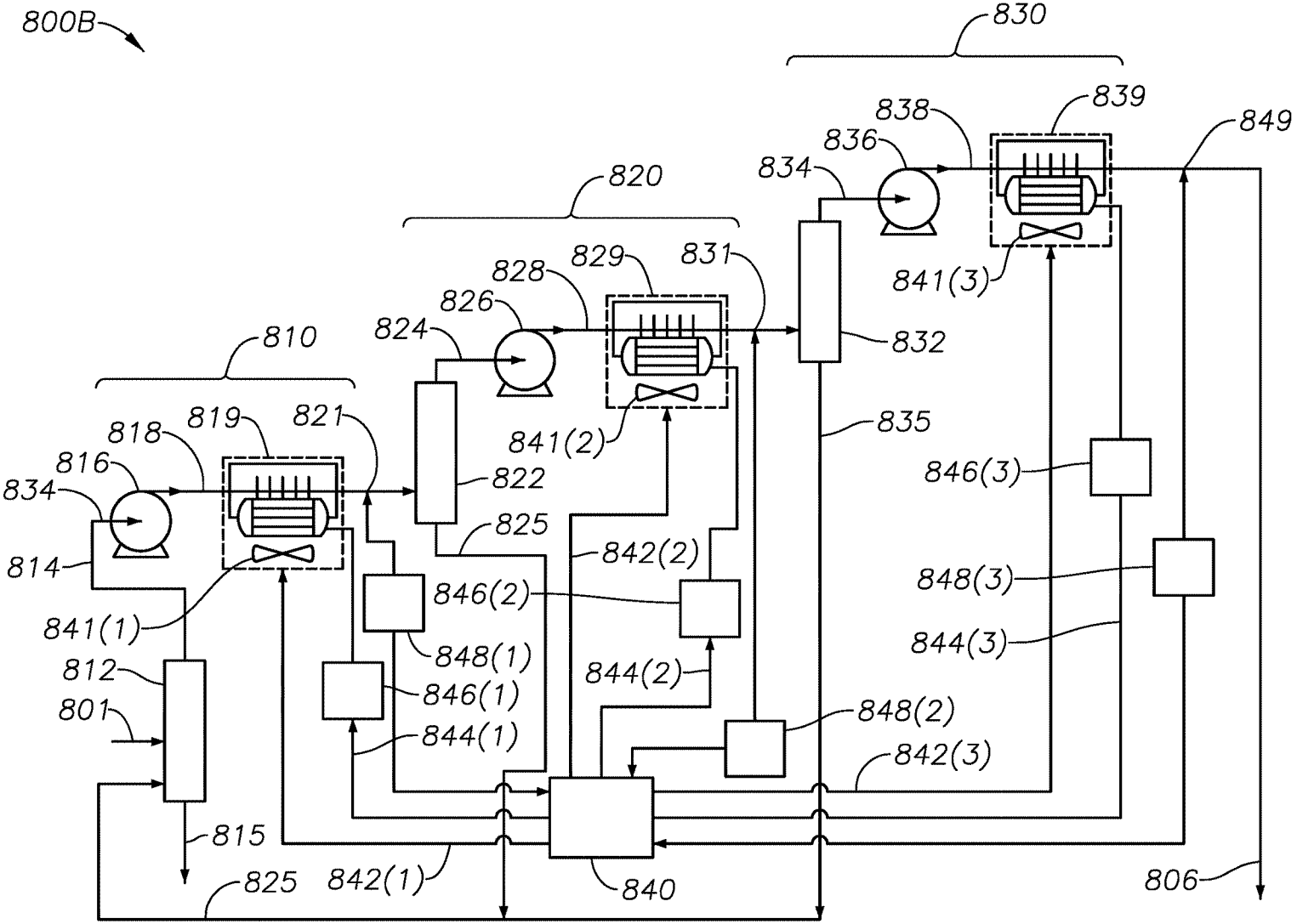
FIG. 8B is a second schematic illustration of an improved gas compressor system for a wellbore, based on advanced controls using a process controller. The illustrative gas compressor system is a three-stage system utilizing a scrubber along each stage.

In one embodiment, temperature is adjusted by adjusting the position of louvers (shown schematically at 841 in FIGS. 8A and 8B. This may be done, for example, through the use of air motors (shown schematically at 846 in FIGS. 8A and 8B).

Figure 6A:
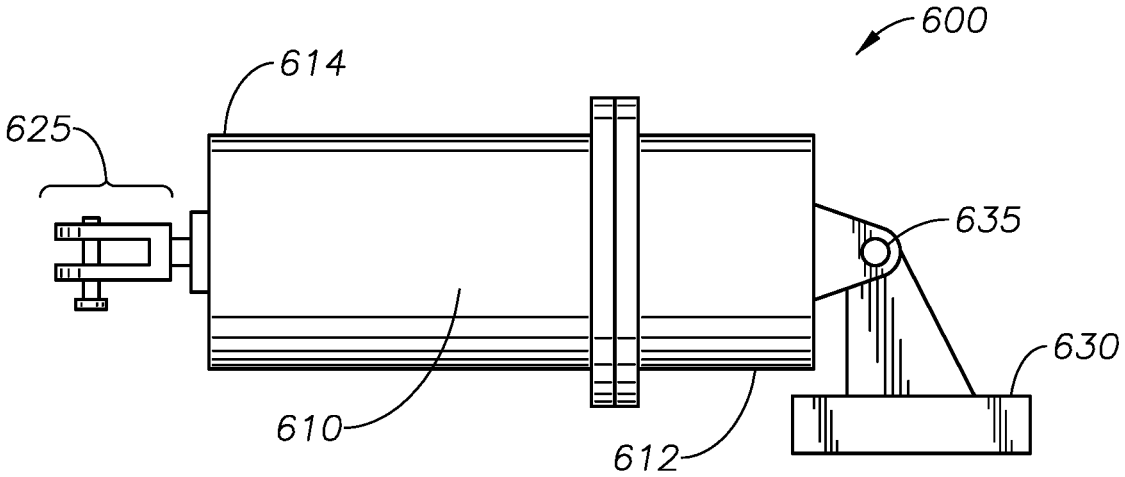
FIG. 6A is a schematic view of an air motor as may be used to control louvers associated with the coolers of the gas compressor system of the present invention, in one embodiment.
Figure 6B:
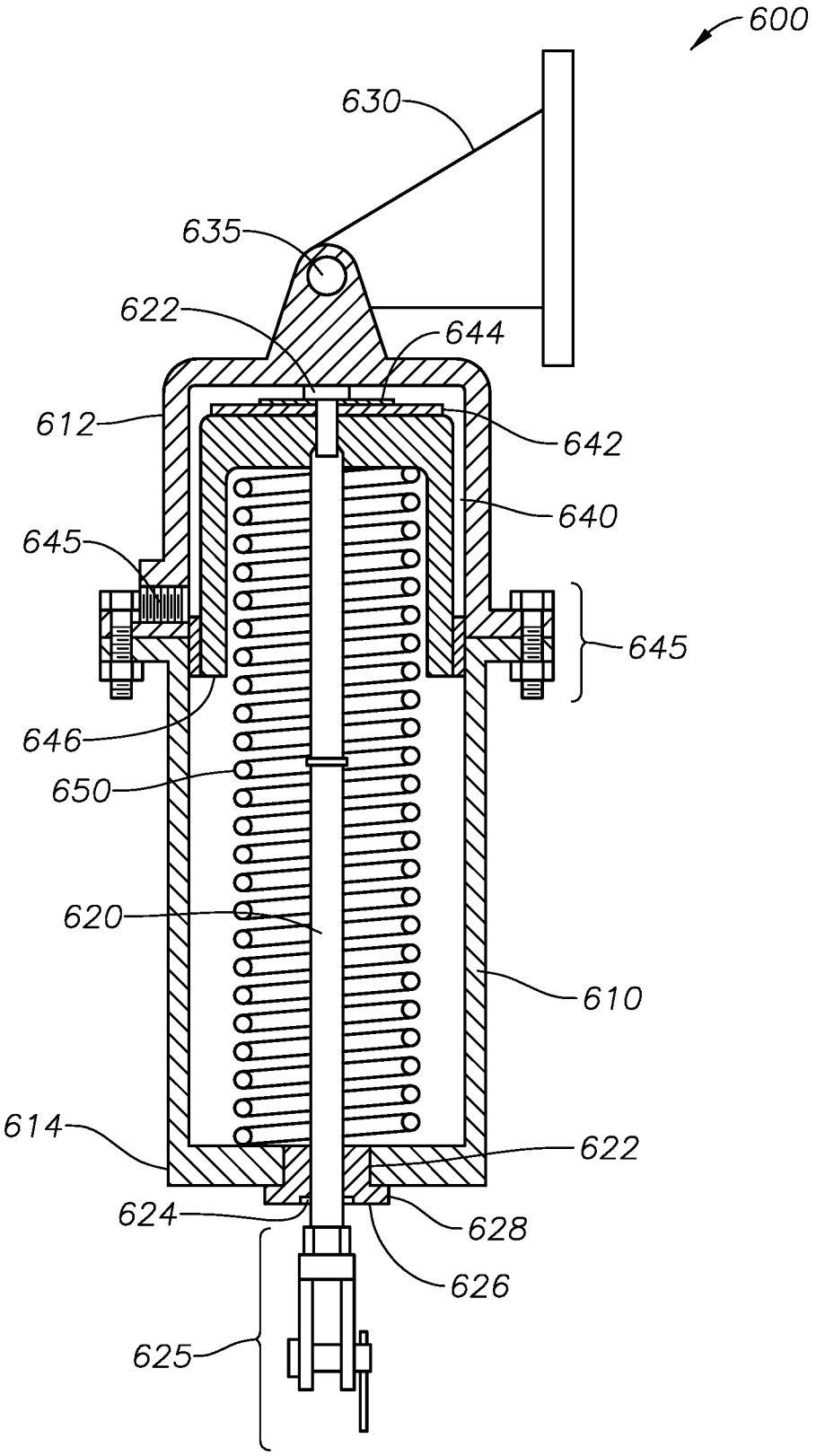
FIG. 6B is a cross-sectional view of the illustrative air motor of FIG. 6A.

FIG. 6A is a photographic view of an illustrative air motor 600A. FIG. 6B is a cross-sectional view of the motor 600A of FIG. 6A. As shown in these views, the motor 600A is a Kimray YAX-1 air motor. The motor 600A is designed to have a maximum operating pressure of 125 psi and to generate up to a 5½" stroke.

It is observed that the air motor is connected to a louver handle at about a right angle. If more stroke (or "travel") is needed, the air motor 600A is repositioned on the louver handle at a position closer to a louver shaft. If less travel is needed, the air motor 600A is connected further out on the louver handle. Since the air motor rod is connected at a right angle to the handle on the louver shaft, if the air motor shaft is moved from 3" away from the louver shaft to 6" away, the louver shaft turns half as much.

The air motor 600A has an aluminum housing 610. The housing 610 has a proximal end 612 and a distal end 614. The proximal end 612 of the housing 610 is secured to hardware in the compressor system through a mounting bracket 630. The mounting bracket 630 connects to the housing 610 by means of a pivoting connection 635. The pivoting connection 635 includes a snap ring and a pin.

The air motor 600A includes an elongated stem 620. The stem 620 defines a stainless steel rod that extends the length of the housing 610. A proximal end of the stem 620 is connected to the proximal end 612 of the housing 610 by means of a lock nut 622. From there, the stem 620 extends through a diaphragm 640. The diaphragm 640 is held within the housing by means of a retainer plate 642 and a retainer washer 644.

A distal end of the stem 620 exits a distal end 614 of the housing 610 through a stem guide 622. The stem guide 622 is held in place by a snap ring 624 and a retainer 626. A wiper 628 is also provided along the stem 620 outside of the distal end 614 of the housing 610. The wiper 628 keeps lubricating oil from leaking through the stem guide 622.

At the end of the stem 620 are various items of stainless steel hardware, referred to collectively at 625. The hardware 625 includes a lock nut, a clevis and pins. The hardware 625 is designed to connect the end of the stem 620 to a cooler louver handle, which is attached to the louver shaft. As the stem 620 moves, the cooler louver is also actuated to either gradually open or gradually close. This is done by pivoting the longitudinal shutters along the louver shaft. More specifically, the stem 620 is operatively engaged to a handle that extends from the pivoting louvers such that travel of the stem 620 causes the handle and connected longitudinal louvers to selectively pivot between open, closed and intermediate positions. As the louver opens, additional air blows across cooling tubes, causing the temperature in the cooler to gradually decrease.

The air motor 600A also includes an elongated spring 650. The spring 650 wraps around the stem 620, and resides in compression between the diaphragm 640 and the distal end 614 of the housing 610. The spring 650 biases the stem 620 in a retracted position.

As shown, the motor 600 also has a pair of female NPT connections 645. These connections 645 receive an air supply at a maximum working pressure of 125 psig. The motor further includes a piston 646. The piston 646 resides just below the diaphragm 640 and moves with the stem 620 in response to pneumatic pressure. As pneumatic pressure builds below the diaphragm 640, the piston 646 overcomes the biasing force exerted by the spring 650. This produces a stroke of the stem 620. In one design, 18 psig of force is required to fully stroke the stem 620 and connected pin 625.

Figure 6D:
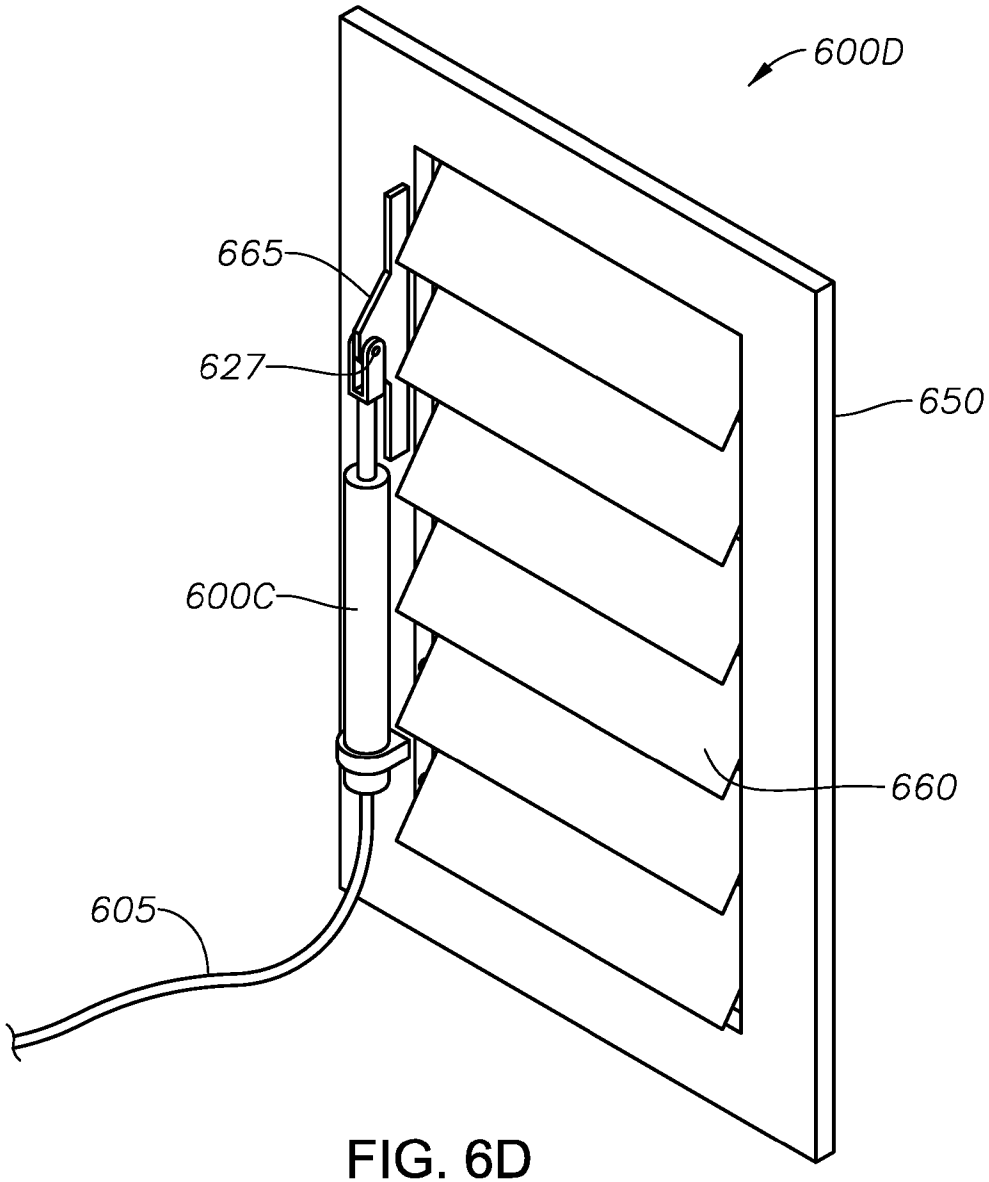
FIG. 6D demonstrates the use of the linear actuator of FIG. 6C in mechanical engagement with an illustrative louver. Linear movement of the position actuator translates into pivotal movement of shutters along the louver.
Figure 6C:
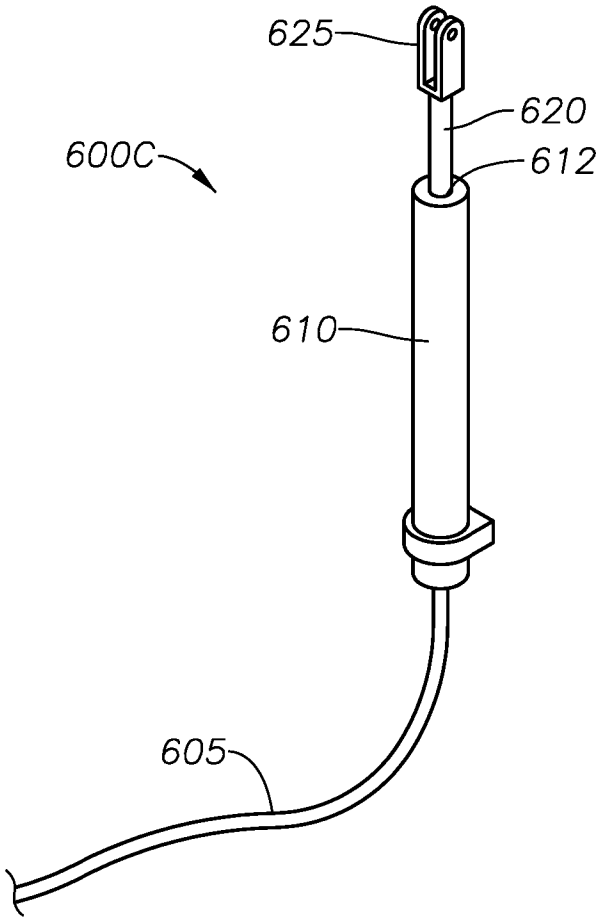
FIG. 6C is a schematic view of a linear actuator as may be used to control louvers associated with the coolers of the gas compressor system of the present invention, in one embodiment. This is an alternative to the use of the air motor of FIGS. 6A and 6B.

It is understood that the air motor 600A shown in FIGS. 6A and 6B is merely illustrative. Any motor that can produce a stroke in response to pneumatic pressure may be used. As an alternative, an electrically driven linear actuator may be used in lieu of an air motor. FIGS. 6C and 6D present an exemplary electric linear actuator 600C.

FIG. 6C is a perspective view of a linear actuator 600C. The illustrative actuator 600C has a small 12 to 24 DC motor, and a feedback resistor to allow detection of the actuator position. The liner actuator 600C includes a line 605 for receiving position signals from the controller 300, and a housing 610. The housing 610 holds a piston 620 that slidably moves through an opening 612 in the housing 610.

A distal end of the piston 620 includes a clevis 625. The clevis 625 is configured to mechanically engage a bracket (seen at 665 in FIG. 6D).

FIG. 6D shows the linear actuator 600C of FIG. 6C in mechanical engagement with an illustrative louver 600D. The louver 600D includes a frame 650, and a series of pivoting shutters 660 along the frame 650. The louver 600D also includes a bracket 665. The bracket 665 is configured to slide along the frame 650.

The bracket 665 is pinned to the clevis 625 by pin 627. Movement of the actuator 600C causes the bracket 665 to slide along the frame 650. This, in turn, causes the shutters 660 along the frame 650 to pivot.

The arrangement of FIGS. 6C and 6D is merely illustrative. Those of ordinary skill in the art will understand that there are various mechanical relationships between an actuator and a louver that may be used.

At any rate, the thermocouple 400, the temperature transmitter 500 and the position actuator 600A or 600C may be used in connection with the new gas compressor system of the present invention. More specifically, a plurality of thermocouples 400 are installed in the piping downstream of each cooler section 210, 220, 230. The thermocouples 400 are configured to measure the real time gas outlet temperature along each outlet line 221, 231, 241. Each thermocouple 400 has an associated temperature transmitter 500 which sends the temperature readings of the respective thermocouples 400 to the process controller 300.

In one embodiment, each cooler 219, 229, 239 will have its own position actuator 600 which receives position signals from the process controller 300. The series of actuators 600 are configured to operate the shutters 680 on the air-cooled heat exchangers 219, 229, 239.

Where air motors 600A are used, the actuators 600A are configured to generate linear movement in the form of strokes in response to pneumatic position signals. For this, the gas compressor system of the present invention will also include either a series of I/P transducers, or a combination of solenoids and air pressure transmitters that serve as de facto I/P transducers. The transducers are designed to convert analog outputs from the process controller 300 into pressure signals, which serve as position signals for the louvers. The position signals are used to operate the Kimray air motors 600A.

Figure 7B:
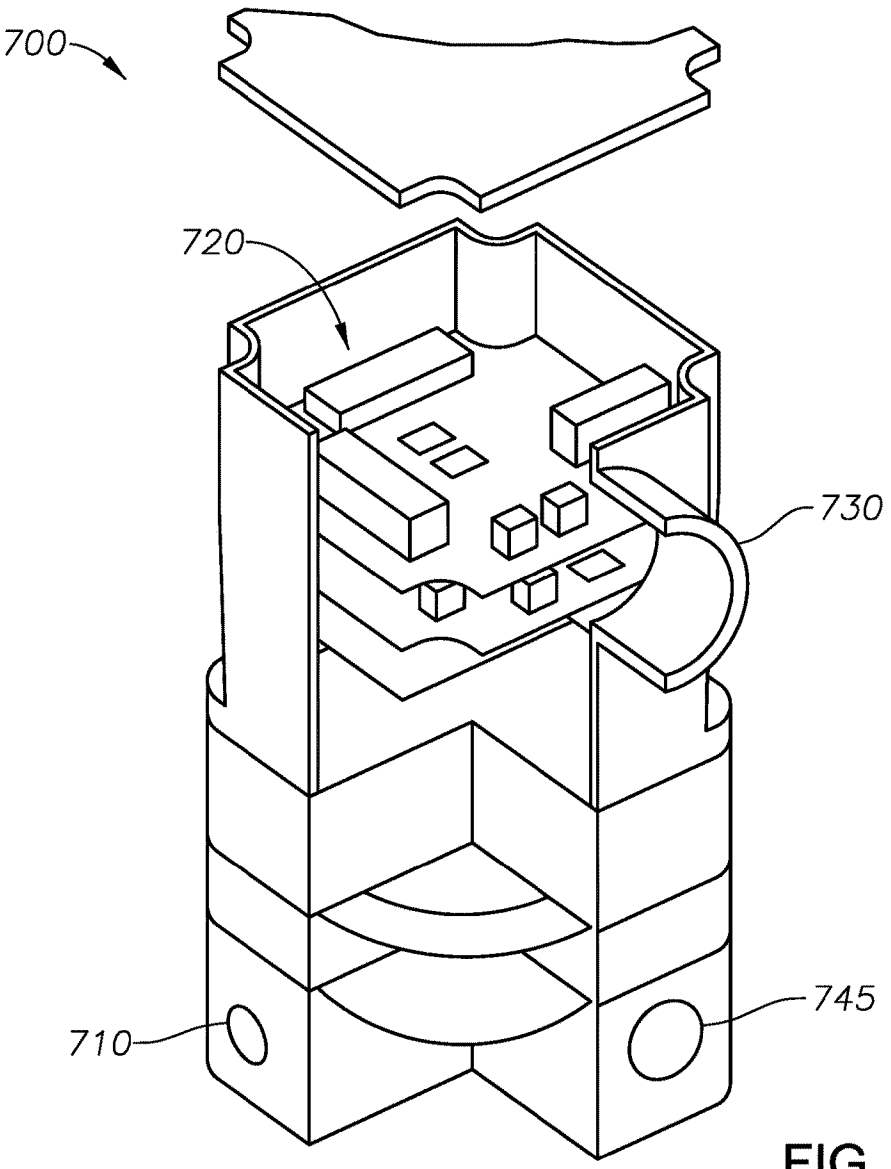
FIG. 7B is an exploded view of the illustrative pressure transducer of FIG. 7A.
Figure 7A:
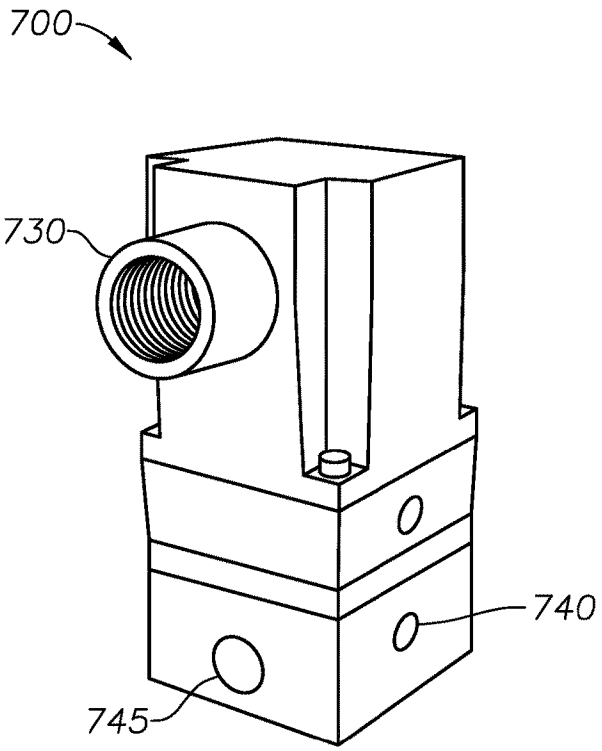
FIG. 7A is a photographic view of an industrial pressure transducer as may be used to relay signals from the process controller of FIG. 3 to the air motor of FIG. 6A or the electric linear actuator of FIG. 6C, in one embodiment.

FIG. 7A is a photographic view of an I/P transducer 700. The illustrative transducer 700 is a Marsh Bellofram Type 2000 transducer. The transducer 700 is designed to regulate an incoming supply pressure down to a precise output that is directly proportional to an electrical control signal. The illustrative Type 2000 transducer 700 operates with an embedded piezo-ceramic actuator to provide more precise and reliable performance under a variety of environmental conditions. The Type 2000 transducer utilizes closed-loop pressure feedback control.

FIG. 7B is a cut-away view of the I/P transducer 700 of FIG. 7A. The cut-away view reveals components of the transducer 700 including a gauge port 710, internal electronics 720, electrical port options 730, an output port 740 and input port 745.

In operation, air supply pressure is received, and then reduced by a supply valve. This provides an output pressure which is internally routed to a precision temperature compensated piezo-resistive pressure sensor. At the same time, air supply pressure is routed to an externally removable orifice which provides a reduced pilot pressure to a chamber containing a servo diaphragm and nozzle. Pilot pressure is controlled by modulating the gap between a face of the nozzle and the adjacent piezo-ceramic actuator.

The piezo-ceramic actuator serves as a control link between electrical input and pressure output as follows: The input current (FP) or voltage (E/P) signal is conditioned to provide a normalized control signal directly proportional to the desired pressure output. Simultaneously, the output of the pressure sensor is amplified and conditioned to produce a feedback signal. The sum of the control signal and the feedback signal produce a command signal which is delivered as a DC voltage to the piezo-ceramic actuator. As voltage increases, the force applied by the actuator increases, so as to restrict nozzle bleed and, thus, increase pilot pressure. Increased pilot pressure applied to the servo-diaphragm directly causes opening of the supply valve and an increase in the output pressure until the output feedback signal and control signal combine to produce the correct command signal.

The command signal serves as a position signal for the air motors 600A. Each air motor 600A receives its own position signal to control the amount of air cross the heat exchange tubes in the respective coolers 219, 229, 239. Where it is desirable to increase the temperature of the discharge from Stage 1 210, the shutters 680 are adjusted to restrict or even close off air flow through the air-cooled heat exchanger 219. Similarly, when it is desirable to increase the temperature of the discharge from Stage 2 220, the shutters 680 are adjusted to restrict or even close off air flow through the air-cooled heat exchanger 229.

Reciprocally, the process controller 300 may sense based on temperature readings from the thermocouples 400 that the discharge temperatures may be lowered. A lower temperature is desirable as it improves the efficiency of the compressors 226, 236, provided of course that the temperature is not so low that the discharge line 241 goes into the liquid phase. Where it is desirable to decrease the temperature of the discharge from Stage 1 210, the shutters 680 are adjusted to close or decrease air flow through the air-cooled heat exchanger 219. Similarly, when it is desirable to decrease the temperature of the discharge from Stage 2 220, the shutters 680 are adjusted to open up or increase air flow through the air-cooled heat exchanger 229. In any instance, air flow is provided by one or more facilities fans.

It is understood that the transducer 700 shown in FIGS. 7A and 7B is merely illustrative. Any device that can translate an analog 4-20 mA or voltage form of electrical signal into an air pressure signal will be satisfactory for the compressor system of the present invention. For example, Kimray's Electro-Pneumatic positioner (EPC-100) may serve as the I/P Transducer. Alternatively, as noted above, a pair of solenoids may be used with an air pressure transducer. In this latter scenario, short bursts of air in or out of the air motor 600A result in certain pressures, with known pressures equating to known air motor positions. The solenoids are simply energized as necessary to achieve the desired pressures, with the only downside being a longer time period to achieve the desired air motor position. The upside to solenoids is a lower installed cost, and perhaps increased reliability.

FIG. 8A presents the gas compressor system 800A of the present invention, in one embodiment. FIG. 8A is a schematic diagram of an improved well site multi-stage compressor system 800A. The multi-stage compressor system 800A utilizes an illustrative three-stage gas compressor. First 810, second 820 and third 830 compression stages are shown. All system components including motors and coolers are controlled by a process controller (or "PLC") 840. Controller 840 may be in accordance with controller 300 described above.

In FIG. 8A, the multi-stage compressor system 800 receives a working fluid through inlet line 801. The working fluid will be a natural gas mixture. The natural gas mixture may comprise methane and any of (i) ethane, (ii) propane, (iii) butane, (iv) pentane, (v) hexanes and higher carbon compounds, (vi) carbon dioxide, (vii) nitrogen, (viii) hydrogen sulfide, or (ix) combinations thereof. The mixture flows through line 801 and enters a fluid separator, noted as scrubber 812. The scrubber 812 is preferably a vertical vessel designed to remove liquid droplets from the mixture in line 801.

In operation, the mixture of line 801 will enter through a diverter, whereupon water and other liquid components will gravitationally fall from the scrubber 812 through line 815. The liquid of line 815 will be sent downstream for further processing. At the same time, the lighter gas components will exit the top of the scrubber 812 through line 814. A mist extractor (not shown) may be provided that captures smaller liquid particles entrained in the gas phase, causing them to also fall to the bottom of the vessel 812.

The gaseous mixture of line 814 is directed to a first compressor 816. The first compressor 816 will pressurize the gases of line 814. The re-pressurized gaseous mixture then exits the first compressor 816 through exit line 818.

The pressurized gaseous mixture of line 818 is directed to a first cooler 819. In one aspect, the cooler 819 is a shell-and-tube heat exchanger. The shell and tube heat exchanger will use a working fluid such as antifreeze or water in the cooling tubes to cool the gas. Instead of controlling the air flow across the tubes using air motors 600A, the cooling fluid rate would be controlled by pumps or control valves.

In another aspect, the cooler 819 comprises a blower that forces air across cooling tubes 809 at the inlet or the outlet of the cooler 819. The blower may be a fan dedicated to the specific cooler 819. In this case, the fan is controlled by the PLC 840 via control line 842(1). Preferably, the fan in this instance operates with a variable frequency drive motor that controls rate of rotation of a fan shaft.

A VFD fan may be employed with each cooler in the gas compression system 800A. This provides a way to control a degree of cooling in each cooler without need of louvers. Individual VFD-driven fans eliminate the need for air motors and associated I/P transducers to control louver positions. In this case, it is typically not necessary to push the adiabatic heat of compression from the first two stages, as the individual fans do an adequate job, as would the shell and tube heat exchangers. Thus, a third stage cooler is not needed.

Alternatively, a fixed speed fan may be provided to blow air across the cooling tubes 809. In this case, actuator devices are used to pivot shutters in louvers as a way to control air movement. Those of ordinary skill in the art will understand that as air moves across coils, such as at a fluid inlet or a fluid outlet, the compressed gaseous mixture from line 818 will be cooled.

Where a fixed speed fan is used, the fan may either be a fan dedicated to the first cooler 819, or may be a system fan that provides air movement across cooling tubes 809 in all system coolers. In either instance, the cooler 819 further includes louvers 841(1) that are controlled by the PLC 840 via control line 844(1). Control line 844(1) is fed to an air motor (or other mechanical actuator) 846(1) for the louver positioning. Where an air motor 600A is used, the actuator may be the Marsh Bellofram Type 2000 transducer 700 shown in FIGS. 7A and 7B.

The louver 841(1) may be placed between the fan and the cooling tubes 809 or coils, carrying the compressed gaseous mixture. The latter is found to provide a greater degree of control over cooling, and to help prevent over-cooling.

The first cooler 819 serves as a heat exchanger and is designed to cool the gaseous mixture discharged from the first compressor 816 through exit line 818. A first cooled mixture is discharged through line 821. This is the end of a Stage 1 for the compressor system 800.

During operation of the compressor system 800, the temperature of the Stage 1 gaseous mixture at line 821 is measured. Temperature sensing may be done using a thermocouple, such as the thermocouple 400 shown in FIG. 4. A first thermocouple is placed at the cooler outlet line 821, with the signal being conditioned by interface 848(1). A conditioned temperature signal is communicated by a temperature transmitter, such as the transmitter 500 shown in FIG. 5. The signal 848(1) is an electrical signal delivered to an input of the PLC 840. The 840 applies a PID loop control so that the first cooler 819 brings the temperature of the gaseous mixture of line 814 down to a lower temperature, but not allowing the gaseous mixture of outlet line 821 to condense from the vapor phase.

The gaseous mixture of outlet line 821 is directed to a Stage 2 compression. In the arrangement of FIG. 8A, the gaseous mixture is directed into a second compressor 826. However, it is preferred that the gaseous mixture of outlet line 821 be directed to a small second scrubber. This is shown at scrubber 822 in the compressor system 800B of FIG. 8B. The second scrubber 822 will necessarily operate at a higher pressure due to the pressurization from the first compressor 816, such as up to 500 psig.

When scrubber 822 is used, the mixture of line 821 will enter through a diverter, whereupon any heavy liquid particles will fall to the bottom of the vessel 822, while lighter gas phase components will rise in the vessel 822. Water and other liquid components will gravitationally fall from the second scrubber 822 to be recycled back into the first scrubber 812 for re-capture, or optionally will tee into line 815 for further processing or sale. Ideally, only a small portion of liquid particles exist in this line.

After compression, the gaseous mixture moves into a second cooler 829. The second cooler 829 may be configured in accordance with the first cooler 819, in any of its embodiments. For example, the second cooler 829 may include a fan having a VFD motor that is controlled by the PLC 840 via control lines 842(2). Alternatively, the second cooler shares a system fan with cooler 819. In this instance, the second cooler 829 also includes louvers 841(2) that are controlled by the PLC 840, such as through illustrative wire line 844(2). Line 844(2) is directed to a position actuator 846(2) that adjusts the shutter positioning. The fan blows air across the cooling tubes 809.

During operation of the compressor system 800A, the temperature of the Stage 2 gaseous mixture at line 831 is measured. Temperature sensing may again be done using the thermocouple 400 at the cooler outlet line 831. A conditioned temperature signal is communicated by a temperature transmitter, such as the transmitter 500, through interface 848(2). The interface 848(2) transmits a conditioned electrical signal to an input of the PLC 840. The 840 applies a PID loop control so that the second cooler 829 brings the temperature of the gaseous mixture of line 828 down to a lower temperature, but not allowing the gaseous mixture of outlet line 831 to condense from the vapor phase.

Optionally, the gaseous mixture of outlet line 831 is directed to a third scrubber. This shown at scrubber 832 in the compressor system 800B of FIG. 8B. The third scrubber 832 may be designed in accordance with the first scrubber 812. However, the third scrubber 832 will necessarily operate at a higher pressure due to the pressurization from the first 816 and the second 826 compressors, that is, up to 1,500 psig.

The mixture of line 831 will enter through a diverter, whereupon any heavy liquid particles will fall to the bottom of the vessel 832, while lighter gas phase components will rise in the vessel 832. A mist extractor (not shown) may optionally be provided that captures smaller liquid particles entrained in the gas phase, causing them to also fall to the bottom of the vessel. Water and other liquid components will gravitationally fall from the third scrubber 832 through line 835 to be recycled back into the first scrubber 812 for re-capture, or optionally will tee into line 815/825 for further processing. Ideally, only a very small portion of liquid particles exist in this line.

The gaseous mixture of line 831 will enter a third compressor 836 via line 834. The third compressor 836 will continue pressurizing the gas mixture of line 831, without overheating. The further-pressurized gaseous mixture then exits the third compressor 836 through exit line 838.

In one aspect, the processor 300 is programmed to know threshold temperature values for each of the first compressor 816, the second compressor 826, and the third compressor 836, and to compare with actual compressor cylinder discharge temperatures. Analysis may be made as to the condition of the cylinders or possible compressor failure.

The further-pressurized gaseous mixture of line 838 is optionally directed to a third cooler 839. The third cooler 839 has a fan that is optionally controlled by the PLC 840, such as through wire 842(3). This again is optionally the same fan that serves the first cooler 819 and the second cooler 829. The third cooler 839 also includes louvers 841(3) that are controlled by the PLC 840, such as through illustrative wire line 844(3). Control is by means of a position actuator (such as an air motor) 846(3) for shutter positioning. The fan blows air across the cooling tubes 809.

The third stage gaseous mixture temperature is measured by a thermocouple signal sensed at the cooler outlet line 849. The signal is conditioned by interface 848(3). The conditioned temperature signal is then communicated electrically to an input of the PLC 840. Under PLC 840 PID loop control; the third cooler 839 brings the temperature of the gaseous mixture of line 838 down to a lower temperature, but not allowing the gaseous mixture of outlet line 549 to condense from the vapor phase.

It is noted here that the third air motor and transducer may not be needed. This is because the warmer the final discharge gas is, the less likely the fluid is to condense. When final discharge pressures are low, with no work being done in the third stage, it is expected to also see that the second air motor is also optional. For example, the second and third louvers can be manually closed, substantially or completely.

The temperature and pressure conditioned and optimized gaseous mixture output at line 849 of the multi-stage compressor system 800A, 800B is provided as a discharge line. The pressurized gas mixture in line 849 feeds into injection tubing 806 to facilitate gas-lift operations.

Figure 9:
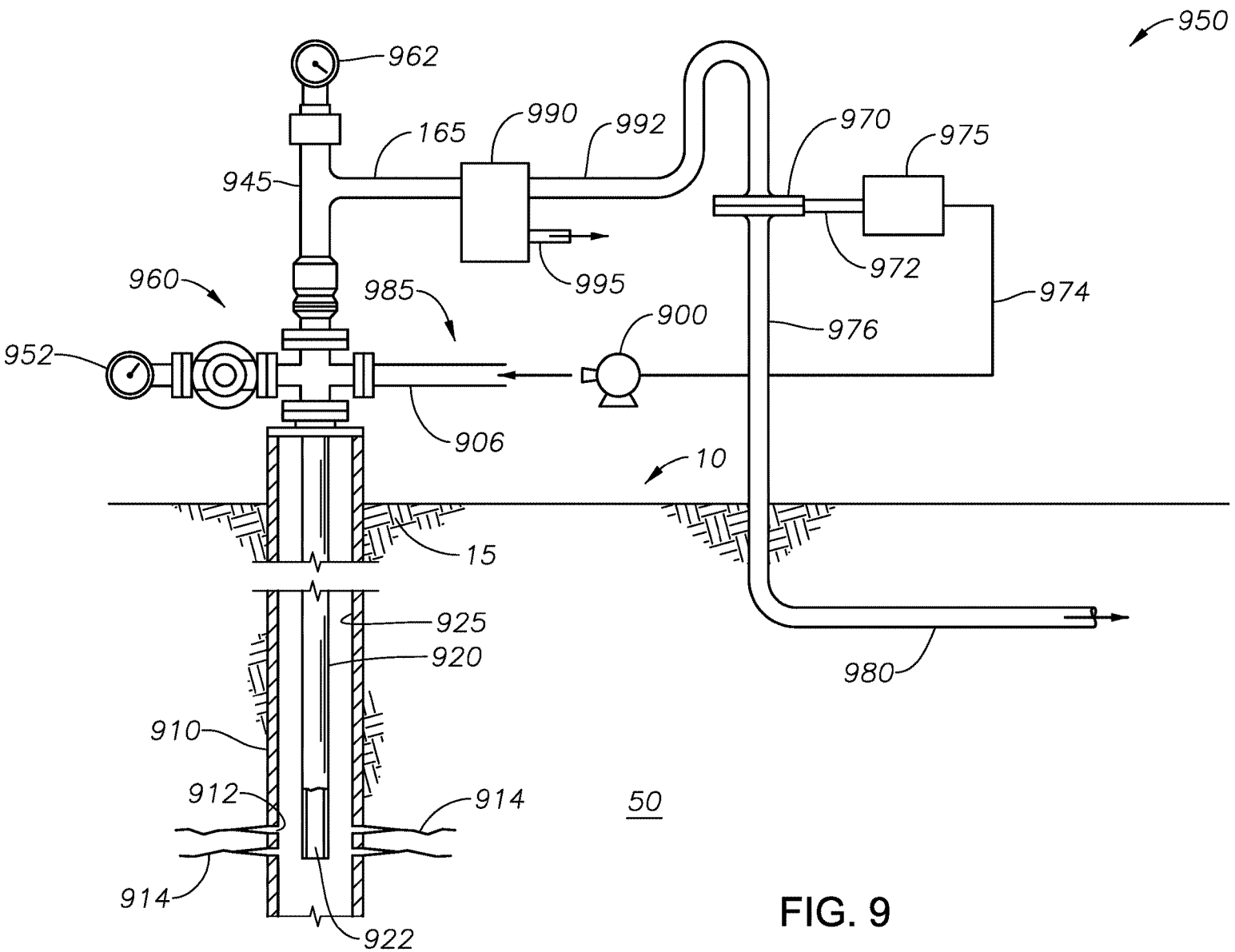
FIG. 9 is a side view of an illustrative wellbore undergoing gas lift. Gas lift is provided in support of the production of hydrocarbon fluids.

FIG. 9 is a side view of an illustrative well 950 undergoing gas lift. Gas lift is provided in support of the production of hydrocarbon fluids. In one aspect, the well 950 produces primarily gas, with diminishing liquid production. In one aspect, produced fluids may have a GOR in excess of 500 or, more preferably, above 3,000.

An optimized gas compression system 900 is shown schematically in FIG. 9. The gas compression system 900 may be in accordance with either of systems 800A or 800B, described above.

In FIG. 9, the well 950 defines a bore that is formed in an earth surface 10, and down to a selected subsurface formation 50. The well 950 includes at least one string of casing 910 which extends from the earth surface 10 and down proximate the subsurface formation 50. In one aspect, the casing 910 represents a string of surface casing, one or more intermediate casing strings, and a string of production casing. For illustrative purposes, only one casing string 910 is presented.

In the view of FIG. 9, the well 950 is shown as having been completed in a vertical orientation. However, it is understood that the wellbore may be completed in a horizontal (or other deviated) orientation.

In FIG. 9, it is seen that the casing 910 has been perforated. Perforations are shown at 912. In addition, the formation 50 has been fractured. Illustrative fractures are presented at 914. Preferably, the casing 910 extends down to a lower end of the subsurface formation 50, and the perforations 912 are placed proximate that lower end. In another aspect, the casing 910 has an elongated horizontal portion (not shown) with openings being provided in the casing 910 through perforating or jetting along stages of the horizontal portion within the subsurface formation 50. Of course, it is understood that the current inventions are not limited by the manner in which the casing 910 is oriented or perforated unless expressly so stated in the claims.

The bore of the well 950 has received a string of production tubing 920. The production tubing 920 extends from a well head 960 at the surface 10, down proximate the subsurface formation 50. An annular region 925 is provided between the tubing string 920 and the surrounding casing string 910. Optionally, a packer (not shown) is placed at a lower end of the tubing string 920 to seal the annular region 925.

The gas compression optimization system 900 is designed to inject a compressible fluid into the annular region 925 of the wellbore 950. The compressible fluid is a light hydrocarbon gas mixture that includes, for example, methane, ethane, propane, carbon dioxide, nitrogen, or combinations thereof. The present inventions are not limited to the type of gas injected unless expressly so stated in the claims. The gas is injected in support of a gas lift system for the wellbore 950. In one aspect, the injected compressible fluid is composed primarily of produced gases.

The compressible fluid is injected through an injection line 906 and into the annular region 925. In one aspect, gas lift valves (not shown) are placed along the production tubing 920 to facilitate injection. In another aspect, gas is injected through one or more orifices, or check valves (not shown), placed at a lower end of the production tubing 920. In still another aspect, gas is injected through a dedicated tubing, or is simply injected into the tubing-casing annulus 925 where it flows down to the perforations 912 and back up the production tubing 920 with produced fluids. Where the production tubing 920 has a packer, a tube or valve may be provided along the packer (not shown) to facilitate annular injection below the production tubing 920. For purposes of the present disclosure, the term "annular region" includes a dedicated flow line that extends down proximate the subsurface region.

In order to control a rate at which gas is injected from line 955 and into the annular region 925, a control valve 985 is provided. In the arrangement of FIG. 9, the control valve 985 is placed along the injection line 906. However, the control valve 985 may alternatively be placed at the well head 960 or adjacent the final stage compressor 836. The control valve 985 may be, for example, a high pressure motor valve.

The control valve 985 as used in the industry maintain a set amount of injection. However, the control valve 985 as presented in the parent application is controlled by a novel and specially-configured controller 975. The controller 975 may be either a pneumatic or electronic pressure differential micro-processor. The control function of the controller 975 is described in greater detail in the parent application, incorporated herein by reference.

A line 945 is seen extending from the well head 960. A first pressure gauge 962 is shown measuring pressure in line 945. Line 965 tees from line 945 and optionally delivers production fluids to a separator 990. The optional separator 990 generates at least two fluid streams—a liquid stream 995 comprising water, oil and/or condensate, and a gas stream 992. Liquids in the liquid stream 995 may optionally be processed, with water being captured for disposal or re-injection, and any hydrocarbons being harvested for further downstream processing or sale. The gas stream 992 represents a production line that delivers light hydrocarbons comprising primarily methane, ethane, propane and, perhaps, impurities such as carbon dioxide, nitrogen and hydrogen sulfide into feed line 801.

An orifice plate 970 may be placed along the gas stream 992. Differential pressure above and below the orifice plate 970 is recorded through line 972, and processed by the controller 975. The controller 975 may be an embedded programmable logic controller (or "PLC"). The controller 975 will include a differential pressure transducer that generates an electrical signal. The signal is digitized and processed by the PLC 975 and associated circuitry.

Additional details concerning the control line 974, the controller 975 and other features of FIG. 9 are provided in the parent application and need not be repeated herein.

It is observed here that the compressor system 800A is merely illustrative. In an alternate arrangement, each of the coolers 819, 829, 839 is served by one large fan running off of the compressor engine, or a single VFD operated fan. Air motors (or other position actuators) are required for the first and second stage louvers when a single fan is used. Additional internal louvers may be employed to reduce the fan output when a VFD operated fan is not feasible.

It is further observed that the compressor system 800A may be modified to employ a dedicated scrubber with each stage. FIG. 8B is a schematic illustration of an improved gas compressor system 800B for a wellbore, based on advanced controls using a process controller 400. The illustrative gas compressor system 800B is again a three-stage system. Here, the system 800B utilizes a scrubber 812, 822, 832 along each stage 810, 820, 830, respectively.

In the compressor system 800B of FIG. 8B, the gaseous mixture of line 821 will enter a second compressor 826 via line 824. The second compressor 826 will continue pressurizing the gaseous mixture of line 824, after scrubbing out liquids. The pressurized gaseous mixture then exits the second compressor 826 through exit line 828.

Various benefits are achieved through the improved compressor systems 800A and 800B. First, there is no longer a need for methanol pumps or for the use of methanol to control line freeze resulting from hydrate formation. This has the incidental benefit of improving work place safety as a result of not having to handle methanol at the well. Those of ordinary skill in the art will understand that methanol burns without a visible flame, creating a risk of heat-related injury. This also has the benefit of removing the time and expense related to normal servicing of methanol pumps.

Another benefit is that a "richer" working fluid is sent downhole (through line 806) to blend with produced oil. Keeping NGL's in the vapor state results in a higher concentration of heavier components mixing with produced well fluids, thereby decreasing the likelihood of paraffinic components precipitating on the interior of the production tubing and lessens the likelihood of paraffin formation in pipes at or near the surface. The elevated injection gas temperatures further serve to lessen the likelihood of paraffin formation. Those of ordinary skill in the art will understand that equilibrium relationships have historically resulted in a "lean" gas-lift gas composition that can absorb heavier components from the produced oils. This increases the likelihood for depositing the heavier components such as paraffin in wellbore tubulars.

Also of benefit, fewer NGL's are introduced to the atmospheric tank battery, causing less load on tank vapor recovery equipment and less likelihood of incinerating these components in the on-site flare. In the event of an undersized vapor recovery system, NGL's will be incinerated in a flare. This is an undesirable practice from the standpoint of the environment. This also causes an economic loss due to the lost value of the flared NGL's.

In addition, the compressor systems 800A and 800B of the present invention provide increased compressor runtime due to less freeze related downtime.

In one aspect, the use of the process controller 840 not only eliminates the need for scrubbers at the second and third stages, but still prevents condensation of NGL's in the second and third coolers. Those of ordinary skill in the art will understand that this condensation can result in the freezing of the inter-stage scrubber fluid outlet lines due to heat of vaporization cooling, unless appropriate volumes of methanol are injected. In this arrangement, it is desirable to preheat the compressor prior to allowing gas to enter.

It is finally observed that the PLC 840 may also be used for the calculation of real-time rod loads, automation of starting, compressor speed control, and other compressor performance indicators and subsequent alarms. Calculation of at least some performance indicators is made possible by the addition of the temperature sensors downstream of each cooler.

As can be seen, an improved compressor system used for injecting a working fluid into a wellbore in support of a gas-lift operation, has been provided. The use of a controller to monitor and adjust temperature along each of the multi-stage outlet lines of the compressor system provides a novel improvement for gas-lift operations.

A method of compression for wellbore injection gas is also provided. The method first includes providing a wellbore. The wellbore has been completed for the production of hydrocarbon fluids. In one instance, hydrocarbon fluids have a GOR in excess of 500 or, more preferably, above 3,000. In one aspect, the wellbore produces primarily gas, with diminishing liquid production.

The wellbore wall preferably comprises two or more strings of casing. The completion also includes a string of production tubing The completion may further include an injection tubing clamped to an o.d. of the production tubing that extends down an annular region formed between the production tubing and a surrounding wellbore wall. The completion may further include at least one gas lift valve installed along the production tubing.

The method also includes providing a compressor system. The compressor system is configured to provide an injection of working gas into the injection tubing for use in a gas-lift operation for the wellbore. The compressor system includes at least a first compression stage, a second compression stage, and a third compression stage. Each stage comprises a gas intake line, a compressor, a cooler, and a gas outlet line extending from a discharge of the cooler. In one aspect, the third stage represents a final compression stage, wherein the outlet line from the final compression stage is provided to the injection tubing. In this instance, the third stage preferably will not need a cooler.

The method next includes providing a process controller. The process controller is designed to receive and process temperature signals, and then send control signals to each cooling stage of the compressor system The method further includes providing a thermocouple downstream of the cooler in each of the stages. Each thermocouple is configured to measure the temperature of the gas in the corresponding gas outlet line. Additionally, the method includes providing a temperature transmitter associated with each thermocouple. The transmitters are configured to transmit signals indicative of real time temperature readings from the associated thermocouple to the process controller. This may be, for example, as an analog input.

The process controller 300 determines the temperature control points to achieve desired temperature goals. Current industry thinking is to manually set cooler outlet temperature set points, hoping to maintain a steady temperature. There is no regard to how downstream stages could benefit from real-time adjustment of upstream cooler outlet temperatures to assist in achieving the desired temperature goals. It is observed that in some cases herein, the outlet lines are maintained at high enough temperatures to increase the efficacy of corrosion treatment and paraffin mitigation programs.

The method next includes injecting the working fluid from the outlet line of the final stage of the compressor system into the annular region within the wellbore. The annular region may be open, or may represent a small dedicated flow tube in the annulus.

The gas compressor system and method described herein are designed to inject a compressible fluid into the annular region of a wellbore. The compressible fluid may be a light hydrocarbon gas such as methane, ethane, propane, pentanes, $C_6$+ or combinations thereof. In addition, the compressible fluid may include incidental amounts of nitrogen, hydrogen sulfide or carbon dioxide. The present inventions are not limited to the type of gas injected unless expressly stated in the claims. The gas is injected in support of a gas lift system for the wellbore. In one aspect, the injected compressible fluid is composed primarily of produced gases.

A method of injecting a compressible gas into a wellbore in support of a gas-lift operation is also provided herein. The method employs the multi-stage gas compressor system as described above, in its various embodiments. Preferably, the gas compressor system is associated with a wellbore that is horizontally completed, but this is certainly not required.

The method first includes providing a wellbore. The wellbore has been formed for the purpose of producing hydrocarbon fluids to the surface in commercially viable quantities. Preferably, the well primarily produces hydrocarbon fluids that are compressible at surface conditions, e.g., methane, ethane, propane and/or butane.

The method next includes associating a multi-stage gas compressor with the wellbore. The multi-stage gas compressor comprises a first stage cooler, a second stage cooler and an optional final stage cooler. The method also includes producing hydrocarbon fluids through a production tubing in the wellbore, up to the surface, and into a production line. An annular region is formed between the production tubing and a surrounding casing string.

In the method, discharge temperatures from each of the coolers are controlled in real time. In one aspect, the multi-stage compressor system comprises three stages, meaning that the final stage cooler is a third stage cooler. Temperature control points of the first and/or second stage cooler discharges are automatically controlled by a process controller in order to push heat produced by adiabatic compression to a third (or final) stage, so that discharge temperatures at the third (or final) stage are elevated to maintain injection gas in vapor phase, and thereby preventing line freeze.

Keeping final discharge temperatures above 150° F., and as high as 250° F., will result in elevated well flowing temperatures, as the heat is transferred from the injected gas going down the tubing-casing annulus into the production tubing containing produced oil and the returning injection gas. This additionally prevents paraffin deposition.

In one aspect, the method also includes producing hydrocarbon fluids through a production tubing, and up to a production line at the surface.

Further, variations of the method for compressing gas for gas lift operations may fall within the spirit of the claims, below. For example, FIGS. 8A and 8B each show a three-stage compressor system. However, the method herein has equal application to two- or four-stage compressor systems. A four-stage compressor would be desirable if a 4,000 psi gas-lift discharge pressure was needed. It will be appreciated that the inventions are susceptible to other modifications, variations and changes without departing from the spirit thereof.

I claim:

1. A method of injecting a compressible gas mixture into a wellbore for a gas-lift operation, comprising:

associating a multi-stage gas compressor with the wellbore, wherein the multi-stage gas compressor comprises:

an inlet line configured to receive a working fluid comprising a natural gas mixture at a first pressure, a first stage compressor for compressing the working fluid to a second pressure that is higher than the first pressure, a first cooler that receives the gaseous mixture from the first stage compressor and cools the gaseous mixture to a first cooled temperature using a fan, and then discharges the cooled gaseous mixture as a first stage, a second stage compressor that receives the cooled gaseous mixture from the first stage and discharges the gaseous mixture at a third pressure that is higher than the second pressure, a second cooler that receives the gaseous mixture from the second stage compressor and cools the gaseous mixture to a second cooled temperature also using a fan, and then discharges the cooled gaseous mixture as a second stage, a final stage compressor that receives the gaseous mixture from the second stage and discharges the cooled gaseous mixture as a third stage, one or more temperature sensors configured to detect a temperature of the gaseous mixture proximate an outlet of each cooler and prior to entering a next downstream compressor, and a single process controller having input and output terminals;

and wherein discharge temperatures of fluids from each of the first and second coolers are independently controlled by the controller in response to real time readings from the one or more sensors by sending signals to the first cooler and the second cooler to adjust a flow of air through each of the first cooler and the second cooler from the fan to (i) automatically elevate temperature set points associated with first and second cooler discharge temperatures so as to maintain the gaseous mixture entering each of the second and third stages at a temperature wherein the gaseous mixture is maintained in a vapor phase, and (ii) to push heat produced by adiabatic compression to the third stage;

discharging a fluid from the final stage compressor in a vapor phase, wherein the discharged fluid comprises methane;

injecting the discharged fluid into an annulus of the wellbore in support of the gas-lift operation; and producing hydrocarbon fluids through a production tubing in the wellbore, and up to a surface.

2. The method of claim 1, wherein:

the temperature set points of the first and second cooler discharges are automatically controlled by the process controller in order to maintain discharge temperatures throughout the compression process in an elevated state to maintain the gas mixture in vapor phase, and thereby prevent line freeze within a discharge line from the final stage compressor.

3. The method of claim 2, wherein the multi-stage gas compressor further comprises:

a fluid separator configured to remove liquids from the natural gas mixture before entering the first stage compressor.

4. The method of claim 3, wherein the multi-stage gas compressor further comprises:

a third cooler configured to receive the compressed gaseous mixture from the final stage compressor, and cool the gaseous mixture to a third cooled temperature, and then discharge the cooled gaseous mixture as the third stage;

and wherein the process controller is further configured to send signals to the third cooler to maintain the gaseous mixture at the third stage in a vapor phase.

5. The method of claim 3, wherein the natural gas mixture comprises methane and any fluid selected from the group comprising (i) ethane, (ii) propane, (iii) butane, (iv) pentane, (v) hexane-plus, (vi) carbon dioxide, (vii) nitrogen, or (viii) hydrogen sulfide.

6. The method of claim 5, wherein the multi-stage gas compressor further comprises:

a second fluid separator configured to receive the cooled gaseous mixture from the first cooler before the cooled gaseous mixture reaches the second stage compressor; and a liquids outlet line configured to receive liquids separated from the cooled gaseous mixture in the second fluid separator, and route the fluids to a separate production fluids separator.

7. The method of claim 3, wherein:

the fan that cools the gaseous mixture to a first cooled temperature and the fan that cools the gaseous mixture to a second cooled temperature is the same fan, such that each of the first and second coolers is cooled by a single shared fan;

each of the coolers comprises a louver having longitudinal shutters; and air movement from the single shared fan across cooling tubes of the respective coolers is controlled by the adjustment of shutters along the louvers of the first and second coolers.

8. The method of claim 3, wherein:

the fan that cools the gaseous mixture to a first temperature and the fan that cools the gaseous mixture to a second temperature are separate fans; and each fan comprises a Variable Frequency Drive motor having a rotation speed controlled by the process controller, wherein the process controller adjusts a flow of air by (i) adjusting a speed of the fan, (ii) adjusting a position of an actuator device that in turn will adjust louvers associated with the first and second coolers, or (iii) both, to optimize an amount of air being blown across cooling tubes of the first and second coolers.

9. The method of claim 3, wherein the multi-stage gas compressor further comprises:

a first louver placed along the first cooler;

a first position actuator mounted to the first louver and configured to adjust a position of shutters associated with of the first louver and, thereby, adjust air flow across cooling tubes within the first cooler;

a first transducer configured to receive electrical signals from the process controller, and convert the electrical signals from the process controller into position signals for the first position actuator;

a second louver placed along the second cooler;

a second position actuator mounted to the second louver and configured to adjust a position of shutters associated with the second louver and, thereby, adjust air flow across cooling tubes within the second cooler; and a second transducer configured to receive electrical signals from the controller, and convert the electrical signals from the process controller into position signals for the second position actuator;

and wherein the electrical signals from the process controller comprise temperature control points for the respective coolers.

10. The method of claim 9, wherein each of the first and second position actuators comprises an air motor or an electric linear actuator.

11. The method of claim 10, wherein the multi-stage gas compressor further comprises:

a third cooler configured to receive the gaseous mixture from the third compressor before the discharge, and cool the gaseous mixture to a third cooled temperature, and then discharge the cooled gaseous mixture as the third stage;

a third louver placed along the third cooler;

a third position actuator mounted to the third louver and configured to adjust a position of shutters associated with the third louver and, thereby, adjust air flow across cooling tubes within the third cooler; and a third transducer configured to receive electrical signals from the process controller, and convert the electrical signals from the process controller into position signals for the third position actuator.

12. The method of claim 3, wherein the multi-stage gas compressor further comprises:

a first louver placed along an inlet or outlet of the first cooler;

a first air motor mounted to the first louver;

a first air pressure transmitter mounted to the first louver and configured to sense a position of the first air motor;

a first solenoid pair configured to receive electrical signals from the process controller, and convert the electrical signals from the process controller into air pressure signals to position the first air motor;

a second louver placed along an inlet or outlet of the second cooler;

a second air motor mounted to the second louver;

a second air pressure transmitter mounted to the second louver and configured to sense a position of the second air motor;

a second solenoid pair configured to receive electrical signals from the process controller, and convert the electrical signals from the process controller into air pressure signals to position the second air motor; and a third louver placed along an inlet or outlet of the third cooler;

and wherein the electrical signals from the process controller comprise temperature control points for the respective coolers.

13. The method of claim 3, wherein the gas compressor system further comprises:

a first thermocouple, as one of the at least one temperature sensors, placed along a gas outlet line from the first stage cooler configured to measure a gas outlet temperature at the first stage as real time temperature readings;

a first signal conditioner configured to convert the real time temperature readings from the first stage into analog input signals, and transmit the first stage analog input signals to the process controller;

a second thermocouple placed along a gas outlet line from the second stage cooler configured to measure a gas outlet temperature at the second stage as real time temperature readings; and a second signal conditioner configured to convert the real time temperature readings from the second stage into analog input signals, and transmit the second stage analog input signals to the process controller.

* * * * *